US010297200B2

(12) United States Patent
Kim et al.

(10) Patent No.: US 10,297,200 B2
(45) Date of Patent: May 21, 2019

(54) DISPLAY DEVICE, PANEL DEFECT DETECTION SYSTEM, AND PANEL DEFECT DETECTION METHOD

(71) Applicant: LG Display Co., Ltd., Seoul (KR)

(72) Inventors: EungKyu Kim, Gyeonggi-do (KR); SinKyun Park, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 88 days.

(21) Appl. No.: 15/195,079

(22) Filed: Jun. 28, 2016

(65) Prior Publication Data

US 2017/0004773 A1 Jan. 5, 2017

(30) Foreign Application Priority Data

Jun. 30, 2015 (KR) ..... 10-2015-0093818

(51) Int. Cl.

| | |
|---|---|
| ***G09G 3/00*** | (2006.01) |
| ***G09G 3/32*** | (2016.01) |
| ***G09G 3/325*** | (2016.01) |
| ***G09G 3/3258*** | (2016.01) |

(Continued)

(52) U.S. Cl.

CPC ..... *G09G 3/3258* (2013.01); *G09G 3/006* (2013.01); *G09G 3/32* (2013.01); *G09G 3/325* (2013.01); *G09G 3/3266* (2013.01); *G09G 3/3283* (2013.01); *G09G 2300/0809* (2013.01); *G09G 2310/0286* (2013.01); *G09G 2310/0291* (2013.01); *G09G 2320/0646* (2013.01); *G09G 2330/028* (2013.01); *G09G 2330/045* (2013.01); *G09G 2330/12* (2013.01)

(58) Field of Classification Search

None

See application file for complete search history.

(56) References Cited

U.S. PATENT DOCUMENTS 6,496,168 B1 * 12/2002 Tomida ..... G09G 3/3216 315/169.3

2007/0176868 A1 8/2007 Lee et al.
2011/0115770 A1 5/2011 Seo et al.

(Continued)

FOREIGN PATENT DOCUMENTS

| | | |
|---|---|---|
| CN | 101008729 A | 8/2007 |
| CN | 103137049 A | 6/2013 |
| CN | 102222463 B | 8/2014 |

OTHER PUBLICATIONS

Extended European Search Report dated Oct. 28, 2016, issued in corresponding European Patent Application No. 16176597.9.

(Continued)

*Primary Examiner* — Ifedayo B Iluyomade

(74) *Attorney, Agent, or Firm* — Morgan, Lewis & Bockius LLP

(57) ABSTRACT

A display device is provided in which a control switching element arranged in a location to which a voltage used for driving a display panel is applied may identify whether an abnormal current has occurred in the display panel in an off-situation so as to easily and accurately detect whether or not a panel defect exists, in a panel defect detection interval wherein the panel defect detection interval is an interval having no abnormal current occurring therein when no panel defect exists. A panel defect detection system and a panel defect detection method are also provided.

23 Claims, 32 Drawing Sheets

(51) Int. Cl.
*G09G 3/3266* (2016.01)
*G09G 3/3283* (2016.01)

(56) References Cited

U.S. PATENT DOCUMENTS

| | | | | |
|---|---|---|---|---|
| 2011/0254871 | A1 | 10/2011 | Yo et al. | |
| 2013/0002736 | A1* | 1/2013 | Park | G09G 3/3225 345/691 |
| 2013/0134986 | A1 | 5/2013 | Yun et al. | |

OTHER PUBLICATIONS

Chinese Office Action dated Feb. 3, 2019, issued in corresponding Chinese Patent Application No. 20161087008.4.

* cited by examiner

DISPLAY DEVICE, PANEL DEFECT DETECTION SYSTEM, AND PANEL DEFECT DETECTION METHOD

CROSS REFERENCE TO RELATED APPLICATION

This application claims priority from Korean Patent Application No. 10-2015-0093818, filed on Jun. 30, 2015, which is hereby incorporated by reference for all purposes as if fully set forth herein.

BACKGROUND OF THE INVENTION

1. Field of the Invention

The present embodiments relate to a display device, a panel defect detection system, and a panel defect detection method.

2. Description of the Related Art

As the information society develops, display devices for displaying an image are being increasingly required in various forms, and in recent years, various display devices such as liquid crystal displays (LCDs), plasma display panels (PDPs), and organic light emitting display devices (OLEDs) have been utilized.

Signal lines such as various voltage wirings, various circuit elements such as a transistor and a capacitor, and various patterns exist in a display panel of these various devices. When a defect occurs in such a display panel, an abnormal current such as an overcurrent that is a situation where a current excessively flows beyond a normal range, or current flowing in a situation where no current is allowed to flow may occur in the display panel.

When such an abnormal current occurs in the display panel, high temperature of heat may be generated. Accordingly, a phenomenon by which a part of the display panel (e.g., a circuit element, a polarizing plate, etc.) or the entire display panel is burned may occur.

So far, various techniques to detect an abnormal current such as an overcurrent have been presented in a circuit technology field.

However, a related art detection technique not only has a limitation in detecting a panel defect of a display panel but also merely corresponds to an overcurrent detection technique, and is not a technique to accurately detect even a very small current flowing in a situation where no current is allowed to flow.

In addition, related art detection techniques have had not only a disadvantage of a high cost in using and implementing a complicated detection circuit, but also a problem by which detection accuracy is significantly lowered.

Further, related art detection techniques have had a problem by which an abnormal current caused by various reasons is unable to be detected.

Further, related art detection techniques have had a problem by which preventing a circuit from being damaged or burned in advance is impossible due to incapability of immediately and quickly detecting an abnormal current at the time of the occurrence of an overcurrent.

SUMMARY

Accordingly, the present invention is directed to a display device, a panel defect detection system, and panel defect detection method that substantially obviate one or more of the problems due to limitations and disadvantages of the related art.

An object of the present invention is to provide a display device capable of detecting a panel defect through sensing a current occurring in a display panel, a panel defect detection system, and a panel defect detection method.

Another object of the present embodiments is to provide a display device capable of more accurately detecting a panel defect by converting a current generated in a display panel to voltage and sensing the same, a panel defect detection system, and a panel defect detection method.

Another object of the present invention is to provide a display device capable of enabling panel defect detection using a simple circuit, a panel defect detection system, and a panel defect detection method.

Another object of the present invention is to provide a display device capable of accurately detecting various kinds of panel defects, a panel defect detection system, and a panel defect detection method.

Another object of the present invention is to provide a display device capable of preventing a part of or an entire display panel from being damaged or burned in advance, by immediately and quickly detecting a panel defect at the time of the occurrence of the panel defect, a panel defect detection system, and a panel defect detection method.

Another object of the present invention is to provide a display device capable of detecting a panel defect without affecting a user's viewing or a screen operation at all, a panel defect detection system, and a panel defect detection method.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described a display device in which a control switching element arranged in a location to which a voltage used for driving a display panel is applied may identify whether an abnormal current has occurred in the display panel in an off-situation so as to easily and accurately detect a panel defect in a panel defect detection interval wherein the panel defect detection interval is an interval having no abnormal current occurring therein when no panel defect exists; a panel defect detection system; and a panel defect detection method.

In another aspect, a display device comprises a display panel in which multiple data lines and multiple gate lines are arranged and multiple subpixels are arranged; a control switching element electrically connected between an application node in which a voltage used for driving the display panel is applied to the display panel and a supply node that supplies the voltage for being applied to the display panel; and a sensing module for sensing a current flowing through the application node or a voltage according to the current when the control switching element is turned-off.

The control switching element of the display device may be turned-off in a state where an abnormal current in the display panel has not occurred.

The control switching element of the display device may be turned-off in an interval displaying a predetermined screen having brightness equal to or lower than a particular value.

In another aspect, a display device comprises a display panel in which multiple data lines and multiple gate lines are arranged and multiple subpixels are arranged, and a sensing module for sensing whether an abnormal current in the display panel has occurred when a screen having brightness equal to or lower than a particular value is displayed in the display panel.

In another aspect, a panel defect detection system comprises a control switching element electrically connected between an application node in which a voltage used for driving the display panel is applied to the display panel and a supply node that supplies the voltage for being applied to the display panel; and a sensing module for sensing a current flowing through the application node or a voltage according to the current when the control switching element is turned-off, and detecting whether or not a panel defect exists, based on a sensing result.

In another aspect, a panel defect detection method comprises a display panel of a display device which multiple data lines and multiple gate lines are arranged and multiple subpixels are arranged.

The panel defect detection method may include setting a panel defect detection environment, by turning off a control switching element electrically connected between an application node in which a voltage used for driving the display panel is applied to the display panel and a supply node that supplies the voltage for being applied to the display panel; detecting whether or not a panel defect exists, based on a sensing result obtained by sensing the size or the presence or absence of occurrence of a current flowing from the display panel to the application node when the control switching element is turned-off; and performing a predetermined countermeasure process for the panel defect when a current flowing from the display panel to the application node occurs or the size of the current flowing from the display panel to the application node is sensed to be equal to or greater than a threshold current value.

The panel defect detection method may further include recognizing, as a panel defect detection interval, an interval for displaying a screen having brightness equal to or lower than a particular value, an interval for sensing a subpixel characteristic value, or an interval for displaying a screen having brightness equal to or lower than a particular value while an image is being driven, before the step for setting a panel defect detection environment.

According to embodiments of the present invention, a display device capable of detecting a panel defect through sensing a current generated in a display panel, a panel defect detection system, and a panel defect detection method can be provided.

In addition, according to the present embodiments, a display device capable of more accurately detecting a panel defect, by converting current generated in the display panel to voltage and sensing the same, a panel defect detection system, and a panel defect detection method can be provided.

Further, according to embodiments of the present invention, a display device capable of enabling panel defect detection using a simple circuit, a panel defect detection system, and a panel defect detection method can be provided.

Further, according to embodiments of the present invention, a display device capable of accurately detecting various kinds of panel defects, a panel defect detection system, and a panel defect detection method can be provided.

Further, according to embodiments of the present invention, a display device capable of preventing a part of or an entire display panel from being damaged or burned in advance, by immediately and quickly detecting a panel defect at the time of the occurrence of the panel defect, a panel defect detection system, and a panel defect detection method can be provided.

Further, according to embodiments of the present invention, a display device capable of detecting a panel defect without affecting a user's viewing or a screen operation at all, a panel defect detection system, and a panel defect detection method can be provided.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
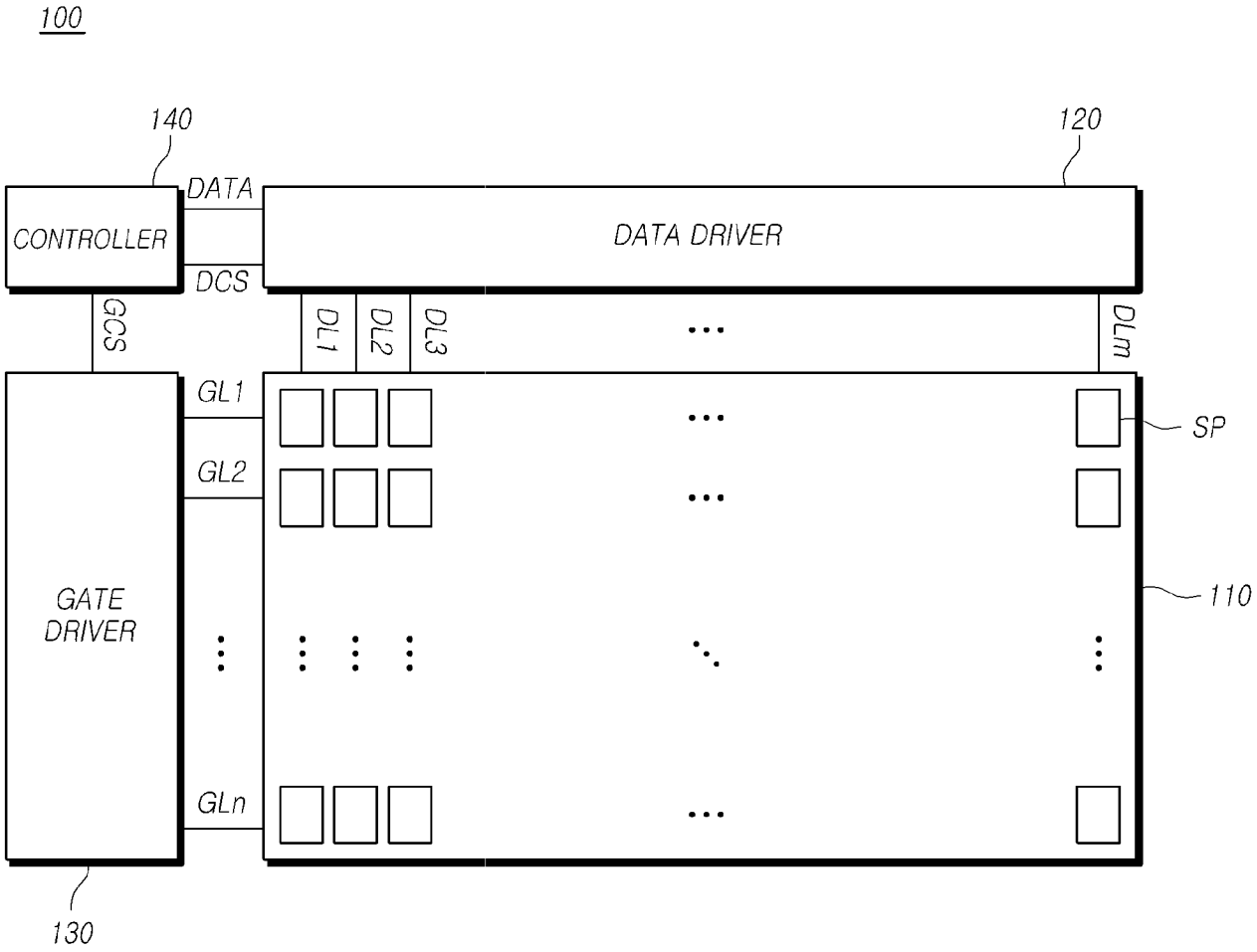
FIG. 1 and FIG. 2 are system configuration diagrams of a display device according to the present embodiments.

Hereinafter, some embodiments of the present invention will be described in detail with reference to the accompanying illustrative drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may be connected to", "be coupled to", or "be in contact with" the structural elements as well as that the certain structural element is directly connected to or is in direct contact with another structural element.

Figure 2:
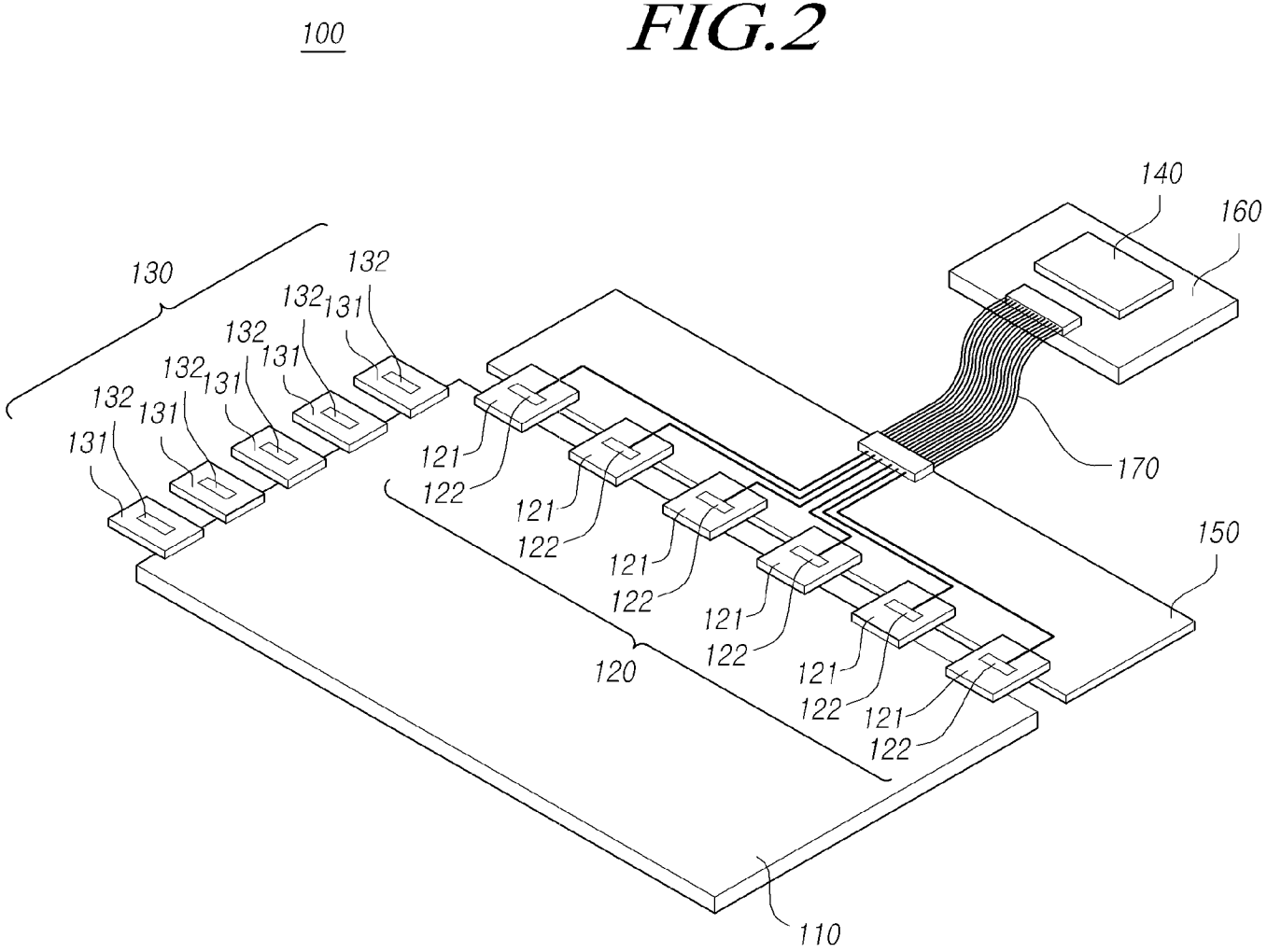

FIG. 1 and FIG. 2 are system configuration diagrams of a display device 100 according to the present embodiments.

Referring to FIG. 1, the display device 100 according to the present embodiments includes a display panel 110 in which multiple data lines DL1-DLm and multiple gate lines GL1-GLn are arranged and multiple subpixels (SP) are arranged, a data driver 120 that drives multiple data lines DL1-DLm, a gate driver 130 that drives multiple gate lines GL1-GLn, and a controller 140 that controls the data driver 120 and the gate driver 130.

The controller 140 supplies various kinds of control signals to the data driver 120 and the gate driver 130 to control the data driver 120 and the gate driver 130.

The controller 140 starts scanning according to timing implemented in each frame, converts input image data input from outside to meet a data signal format used by the data driver 120 and outputs the converted image data (Data), and controls data driving at a proper time for the scanning.

The controller 140 may be a timing controller used in a general display technology or a control device further performing another control function including a function of a timing controller.

The data driver 120 drives multiple data lines DL1-DLm by supplying a data voltage to the multiple data lines DL1-DLm. Here, the data driver 120 is also referred to as "a source driver".

The gate driver 130 sequentially drives multiple gate lines GL1-GLn by sequentially supplying scan signals to the multiple gate lines GL1-GLn. Here, the gate driver 130 is also referred to as "a scan driver".

The gate driver 130 sequentially supplies a scan signal of on voltage or off voltage to multiple gate lines GL1-GLn according to a control of the controller 140.

The data driver 120 converts image data (Data) received from the controller 140 to a data voltage (Vdata) of an analog format to supply the same to multiple data lines DL1-DLm when a particular gate line is open by the gate driver 130.

The data driver 120 is located only at one side (e.g., upper side or lower side) of the display panel 110 in FIG. 1, but may be located at both sides (e.g., upper side and lower side) of the display panel 110 according to a driving scheme, a panel design scheme, and so on.

The gate driver 130 is located at only one side (e.g., left side or right side) of the display panel 110 in FIG. 1, but may be located at both sides (e.g., left side and right side) of the display panel 110 according to a driving scheme, a panel design scheme, and so on.

The described controller 140 receives, from outside (e.g., a host system), various timing signals including a vertical synchronization signal (Vsync), a horizontal synchronization signal (Hsync), an input data enable (DE) signal, a clock signal (CLK), etc., with input image data.

The controller 140, in order to control the data driver 120 and the gate driver 130, receives an input of a timing signal such as a vertical synchronization signal (Vsync), a horizontal synchronization signal (Hsync), an input DE signal, and a clock signal (CLK), generates various control signals, and outputs the same to the data driver 120 and the gate driver 130, in addition to converting input image data input from outside to meet a data signal format used by the data driver 120 and outputting the converted image data.

For example, the controller 140 outputs various gate control signals (GCSs) including a gate start pulse (GSP), a gate shift clock (GSC), a gate output enable (GOE), etc., in order to control the gate driver 130.

Here, the gate start pulse (GSP) controls an operation start timing of one or more gate driver integrated circuits included in the gate driver 130. The gate shift clock (GSC) which is a clock signal commonly input to one or more gate driver integrated circuits controls shift timing of a scan signal (gate pulse). The gate output enable (GOE) designates timing information of one or more gate driver integrated circuits.

Further, the controller 140 outputs various data control signals (DCSs) including a source start pulse (SSP), a source sampling clock (SSC), a source output enable (SOE), etc., in order to control the data driver 120.

Here, the source start pulse (SSP) controls data sampling start timing of one or more source driver integrated circuits included in the data driver 120. The source sampling clock (SSC) is a clock signal controlling sampling timing of data in each source driver integrated circuit. The source output enable (SOE) controls output timing of the data driver 120.

The display device 100 according to the present embodiments described above may be implemented, as an example, like FIG. 2.

Referring to FIG. 2, the data driver 120 may drive multiple data lines including at least one source driver integrated circuit (SDIC) 122.

Each source driver integrated circuit 122 may be connected to a bonding pad of the display panel 110 by a tape automated bonding (TAB) method or a chip on glass (COG) method, or may be directly arranged on the display panel 110. In some cases, the driver integrated circuit 122 may also be integrated on the display panel 110.

Further, each source driver integrated circuit 122 may be implemented in a chip on film (COF) scheme. In this case, each source driver integrated circuit 122 may have one end bonded to at least one source printed circuit board 150 and the other end mounted on a film 121 bonded to the display panel 110.

Each source driver integrated circuit 122 may include a shift register, a latch circuit, a digital-to-analog converter (DAC), an output buffer, and so on.

Referring to FIG. 2, the gate driver 130 may include one or more gate driver integrated circuits (ICs) 132.

Further, the plurality of gate driver ICs 132 may be connected to bonding pads of the display panel 110 by a tape automated bonding (TAB) method or a chip on glass (COG) method, or may be implemented in a gate in panel (GIP) type and directly formed on the display panel 110. In some cases, the gate driver ICs 132 may also be integrated on the display panel 110.

Each gate driver integrated circuit 132 may be implemented in a chip on film (COF) scheme. In this case, the each gate driver integrated circuit 132 may be mounted on a film 131 connected to the display panel 110. Here, the film 131 may be a flexible film.

Each gate driver integrated circuit 132 may include a shift register, a level shifter, and so on.

Referring to FIG. 2, the controller 140, for example, may be arranged on a control printed circuit board 160 connected through a connection medium 170 such as a source printed circuit board 150 having each source driver integrated circuit 122 implemented in a chip on film (COF) type bonded thereto, and a flexible flat cable (FFC) or a flexible printed circuit (FPC).

A power controller (not shown) which supplies various voltages or currents to the display panel 110, the data driver 120, the gate driver 130, etc., or controls the various voltages and currents to be supplied may be further arranged on the control printed circuit board 160.

The source printed circuit board 150 and the control printed circuit board 160 described above may be formed as a single printed circuit board.

The display device 100 according to the present embodiments may be one of various types of devices such as a liquid crystal display device, an organic light emitting display device, and a plasma display device.

Therefore, the display panel 110 may also be one of of various types of panels such as a liquid crystal display panel, an organic light emitting display panel, and a plasma display panel.

Each subpixel SP arranged on the display panel 110 may include a circuit element such as a transistor.

For example, each subpixel SP may include an organic light emitting diode and a circuit element such as a transistor for driving the organic light emitting diode (DRT: driving transistor) when the display panel 110 is an organic light emitting display panel.

A type and the number of circuit elements included in each subpixel SP may be variously determined according to a providing function, a design scheme, and so on.

However, in the following, for convenience of description, the display device 100 and the display panel 110 are assumed to be an organic light emitting display device and an organic light emitting display panel respectively.

Figure 3:
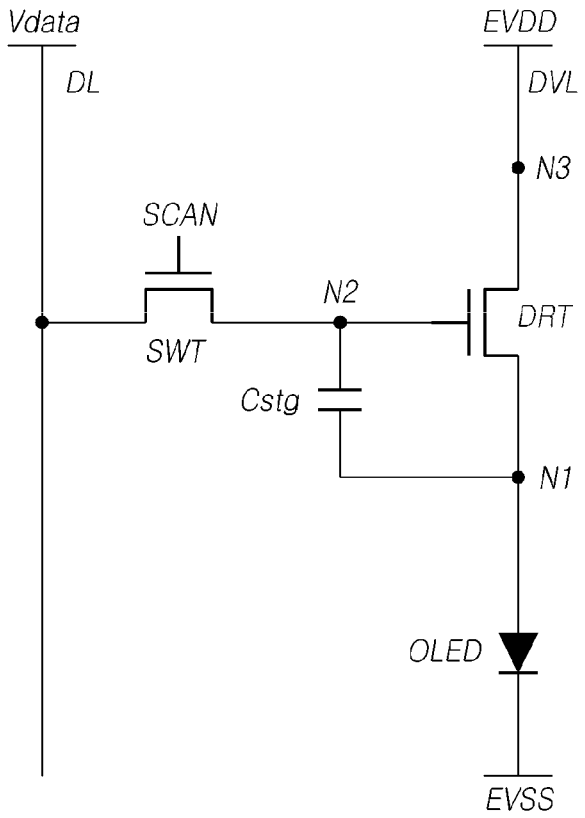
FIG. 3 and FIG. 4 are exemplary diagrams of a subpixel structure of a display device according to the present embodiments.
Figure 4:
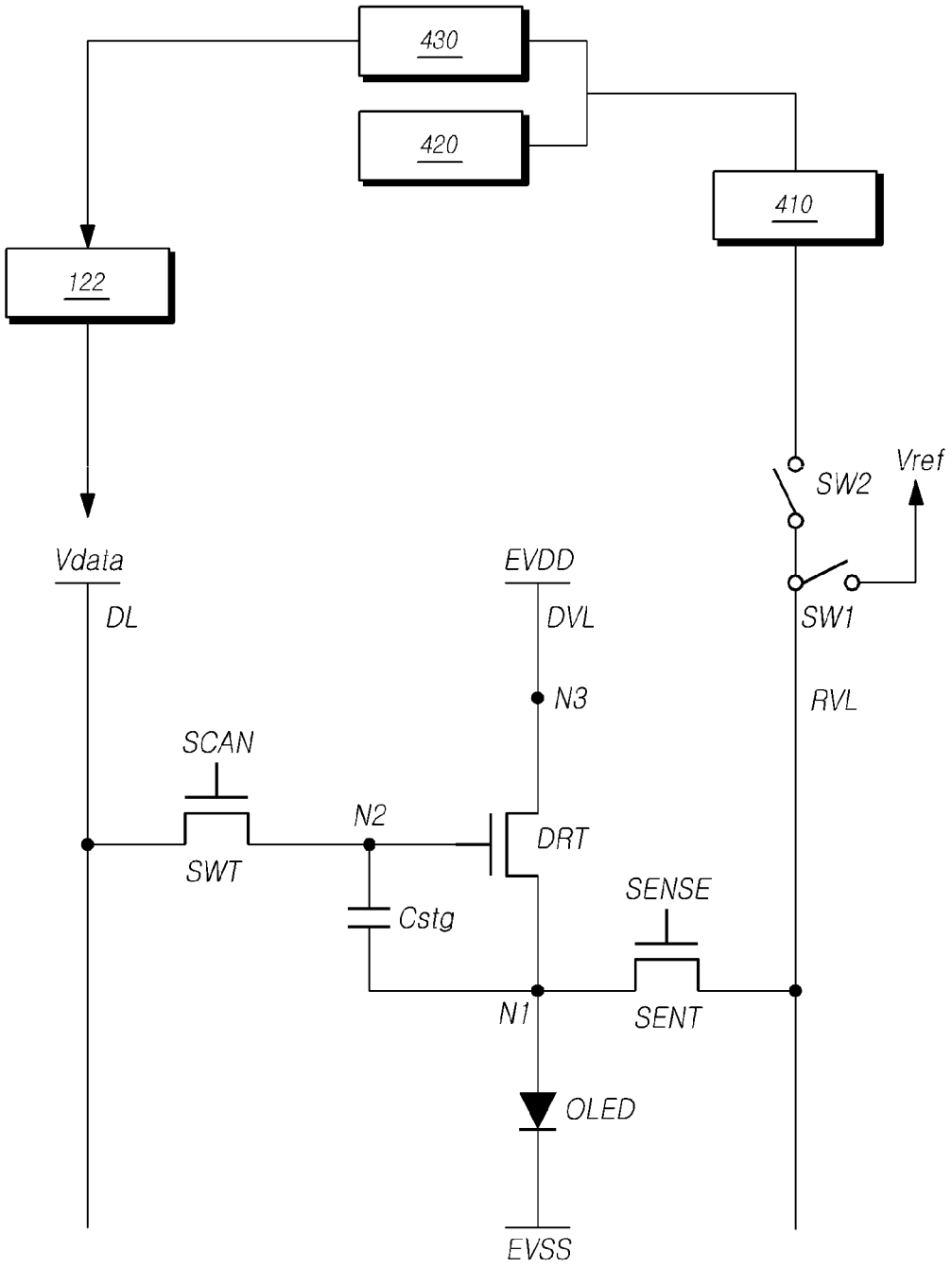

FIG. 3 and FIG. 4 are exemplary diagrams of a subpixel structure of a display device 100 according to the present embodiments.

Referring to FIG. 3, in the display device 100 according to the present embodiments, each subpixel may include, by default, an organic light emitting diode (OLED), a driving transistor DRT for driving the organic light emitting diode (OLED), a switching transistor SWT for transmitting a data voltage to a first node N1 of the driving transistor DRT, and a storage capacitor Cstg maintaining a data voltage corresponding to an image signal voltage or a voltage corresponding to the data voltage for the time of one frame.

The organic light emitting diode (OLED) may include a first electrode (e.g., anode electrode), an organic layer, a second electrode (e.g., cathode electrode), and so on.

The driving transistor DRT drives an organic light emitting diode (OLED) by supplying driving current to the organic light emitting diode (OLED).

The first node N1 of the driving transistor DRT may be connected to the first electrode of the organic light emitting diode (OLED), and may be a source node or a drain node.

A second node N2 of the driving transistor DRT may be connected to a source node or drain node of the switching transistor SWT, and may be a gate node.

A third node N3 of the driving transistor DRT may be connected to a driving voltage line (DVL) supplying driving voltage EVDD, and may be a drain node or a source node.

The driving transistor DRT and the switching transistor SWT may be implemented in n type like an example of FIG. 3, and may be implemented in p type.

The switching transistor SWT may be connected between the data line DL and the second node N2 of the driving transistor DRT, and may be controlled by applying a scan signal SCAN to a gate node through a gate line.

The switching transistor SWT may be turned-on by the scan signal SCAN and transmit a data voltage Vdata supplied by the data line DL to the second node N2 of the driving transistor DRT.

Meanwhile, a circuit element such as an organic light emitting diode (OLED) and a driving transistor DRT may be deteriorated as a driving time of each subpixel SP is prolonged when the display device 100 according to the present embodiments is an organic light emitting display device. Accordingly, unique characteristic values (e.g., a threshold voltage, a mobility level, etc.) of the circuit element such as an organic light emitting diode (OLED), a driving transistor DRT, etc., may be changed.

The level of change in characteristic values among these circuit elements may be different due to a difference in deterioration levels among the circuit elements.

Variation and deviation of characteristic values of the circuit elements may be variation and deviation of characteristic values of subpixels. Further, inaccuracies of luminance of subpixels and luminance deviation among subpixels SP may be generated due to the variation and deviation of characteristic values of subpixels. Therefore, the image quality of the display panel 110 may be lowered.

Here, the characteristic values of subpixels, for example, may be a threshold voltage of the organic light emitting diode (OLED), and may include a threshold voltage and movement level of the driving transistor DRT.

Therefore, the display device 100 according to the present embodiments may provide a subpixel sensing function for sensing variation and deviation of a characteristic value of a subpixel, and a subpixel compensation function for compensating for variation and deviation of the subpixel using a sensing result.

In this case, a change in a subpixel structure, sensing, and a compensation configuration may be added.

FIG. 4 is an exemplary diagram of a subpixel structure, sensing, and a compensation configuration when a display device 100 according to the present embodiments is an organic light emitting display device.

Referring to FIG. 4, each subpixel arranged on a display panel 110 according to the present embodiments, for example, may further include a sensing transistor (SENT) in addition to an organic light emitting diode (OLED), a driving transistor DRT, a switching transistor SWT, and a storage capacitor Cstg.

Referring to FIG. 4, the sensing transistor SENT is connected between the first node N1 of the driving transistor DRT and a reference voltage line RVL supplying a reference voltage Vref, and may be controlled by applying a sensing signal SENSE which is a type of a scan signal to the gate node.

The sensing transistor SENT is turned-on by the sensing signal SENSE, and applies the reference voltage Vref supplied through the reference voltage line RVL to the first node N1 of the driving transistor DRT.

In addition, the sensing transistor SENT may also perform a function as a sensing path such that a voltage of the first node N1 of the driving transistor DRT may be sensed.

Meanwhile, the scan signal SCAN and the sensing signal SENSE may be applied to a gate node of the switching transistor SWT and a gate node of the sensing transistor SENT through another gate line, respectively.

In some cases, the scan signal SCAN and the sensing signal SENSE may be applied, as the same signal, to a gate node of the switching transistor SWT and a gate node of the sensing transistor SENT through the same gate line, respectively.

Referring to FIG. 4, the display device 100 according to the present embodiments may include a sensing unit 410, a memory 420 configured to store a sensing result of the sensing unit 410, and a compensation unit 430 configured to compensate for variation and deviation of a characteristic value of a subpixel, in order to sense variation and deviation of a characteristic value of the subpixel.

The display device 100 according to the present embodiments may further include a first switch SW1 and a second switch SW2, in order to control sensing driving, i.e., to control a voltage application state of the first node N1 of the driving transistor DRT in a subpixel SP in a state required for sensing a characteristic value of the subpixel.

The first switch SW1 may control whether or not to supply the reference voltage Vref to the reference voltage line RVL.

When the first switch SW1 is turned-on to supply the reference voltage Vref to the reference voltage line RVL, the reference voltage Vref is applied to the first node N1 of the driving transistor DRT through a turned-on sensing transistor SENT.

Meanwhile, when the voltage of the first node N1 of the driving transistor DRT is in a voltage state reflecting a characteristic value of a subpixel, i.e., the voltage of the reference voltage line RVL is in a voltage state reflecting a characteristic value of a subpixel, the second switch SW2 is turned-on such that the sensing unit 410 and the reference voltage line RVL are connected.

Accordingly, the sensing unit 410 senses the voltage of the reference voltage line RVL in a voltage state reflecting a characteristic value of a subpixel, i.e., the voltage of the first node N1 of the driving transistor DRT. Here, the reference voltage line RVL is also referred to as "a sensing line".

In relation to the reference voltage line RVL, for example, one reference voltage line may be arranged in every subpixel column, and may be arranged in every two or more subpixel columns.

For example, one reference voltage line RVL may be arranged in every one pixel column when one pixel includes four subpixels (red subpixel, white subpixel, green subpixel, and blue subpixel).

A voltage sensed by the sensing unit 410 may be a voltage value for sensing a threshold voltage Vth of the driving transistor DRT, and may be a voltage value for sensing a movement level of the driving transistor DRT.

For example, when a subpixel is operated for sensing a threshold voltage of the driving transistor DRT, the first node N1 and second node N2 of the driving transistor DRT are initialized to a data voltage Vdata for the threshold voltage sensing operation and a reference voltage Vref, according to the threshold voltage sensing operation, respectively. Then, the first node N1 of the driving transistor DRT is floated such that the voltage of the first node N1 of the driving transistor DRT increases, and the voltage of the first node N1 of the driving transistor DRT is saturated after a predetermined time has passed.

The saturated voltage of the first node N1 of the driving transistor DRT corresponds to difference between the data voltage Vdata and the threshold voltage Vth.

Therefore, the voltage sensed by the sensing unit 410 corresponds to a voltage obtained by subtracting the threshold voltage Vth of the driving transistor DRT from the data voltage Vdata.

When a subpixel is operated for sensing a mobility level of the driving transistor DRT, the first node N1 and second node N2 of the driving transistor DRT are initialized to a data voltage Vdata for the mobility level sensing operation and a reference voltage, according to the mobility level sensing operation, respectively, and then both of the first node N1 and second node N2 of the driving transistor DRT are floated to increase voltage.

In this case, a voltage increase speed (the amount of change in a voltage increase value with respect to time) indicates current capacity of the driving transistor DRT, i.e., a mobility level. Therefore, the driving transistor DRT having the larger current capacity (mobility level) has the voltage of the first node N1 of the driving transistor DRT, which increases more steeply.

The sensing unit 410 senses the voltage of the reference voltage line RVL, which increases along the voltage increase of the first node N1 of the driving transistor DRT, after a predetermined time has passed.

The sensing unit 410 converts the sensed voltage for sensing a threshold voltage or a mobility level to an analog value, senses sensing data, and stores the same in the memory 420.

The compensation unit 430 may grasp a characteristic value (e.g., a threshold voltage and a mobility level) of the driving transistor DRT within a corresponding subpixel, based on the sensing data stored in the memory 420, and perform a compensation process of the characteristic value.

Here, the compensation process of the characteristic value may include a threshold voltage compensation process for compensating for the threshold voltage of the driving transistor DRT and a mobility level compensation process for compensating the mobility of the driving transistor DRT.

The threshold voltage compensation process may include a process for calculating a compensation value for compensating a threshold voltage, and storing the calculated compensation value in the memory 420 or changing corresponding image data using the calculated compensation value.

The mobility level compensation process may include a process for calculating a compensation value for compensating a mobility level, and storing the calculated compensation value in the memory 420 or changing corresponding image data using the calculated compensation value.

The compensation unit 430 may supply data changed by changing the image data to the source driver integrated circuit 122 within the data driver 120, through the threshold voltage compensation process or the mobility level compensation process.

Accordingly, the data driver 120 converts the changed data to a data voltage and supplies the same to a corresponding subpixel such that characteristic value compensation (threshold voltage compensation and mobility level compensation) is actually applied.

The compensation unit 430 described above may compensate a characteristic value of the driving transistor DRT to reduce luminance deviation among subpixels or prevent the same.

Meanwhile, the sensing unit 410 may be included in the source driver integrated circuit 122, and implemented in an analog to digital converter (ADC). The memory 420 may be located inside the controller 140 or on the control printed circuit board 160. Further, the compensation unit 430 may be included inside or outside of the controller 140.

Meanwhile, a signal line such as various voltage wirings, various circuit elements such as a transistor, capacitor, etc., and various patterns exist in the display panel 110.

When a defect occurs in the display panel 110, an abnormal current such as an overcurrent that is a situation where current excessively flows over a normal range or a current flowing in a situation where no current is allowed to flow may occur in the display panel 110.

When the abnormal current occurs in the display panel 110, significantly high heat may occur, and accordingly, a phenomenon by which a part of the display panel 110 (e.g., a circuit element, a polarizing plate, etc.) or the entire display panel is burned may occur.

The phenomenon by which a part of or the entire display panel 110 is burned by an abnormal current may be easily checked through, for example, a polarizing plate (also referred to as a polarizing film) located outer part of the display panel 110 being melted.

Therefore, the present embodiments may provide a panel defect detection method for quickly sensing an abnormal current to detect the same as a panel defect when an abnormal current occurs and performing an immediate and effective countermeasure such that a phenomenon by which a part of or the entire display panel 110 is burned by the abnormal current may be prevented in advance, a panel defect detection system therefor, and a display device 100 including the panel defect detection system.

In the following, a panel defect detection method and a panel defect detection system therefor, and a display device 100 including the panel defect detection system is described in more detail. However, for convenience of description, the display device 100, for example, is an organic light emitting display device.

Figure 5:
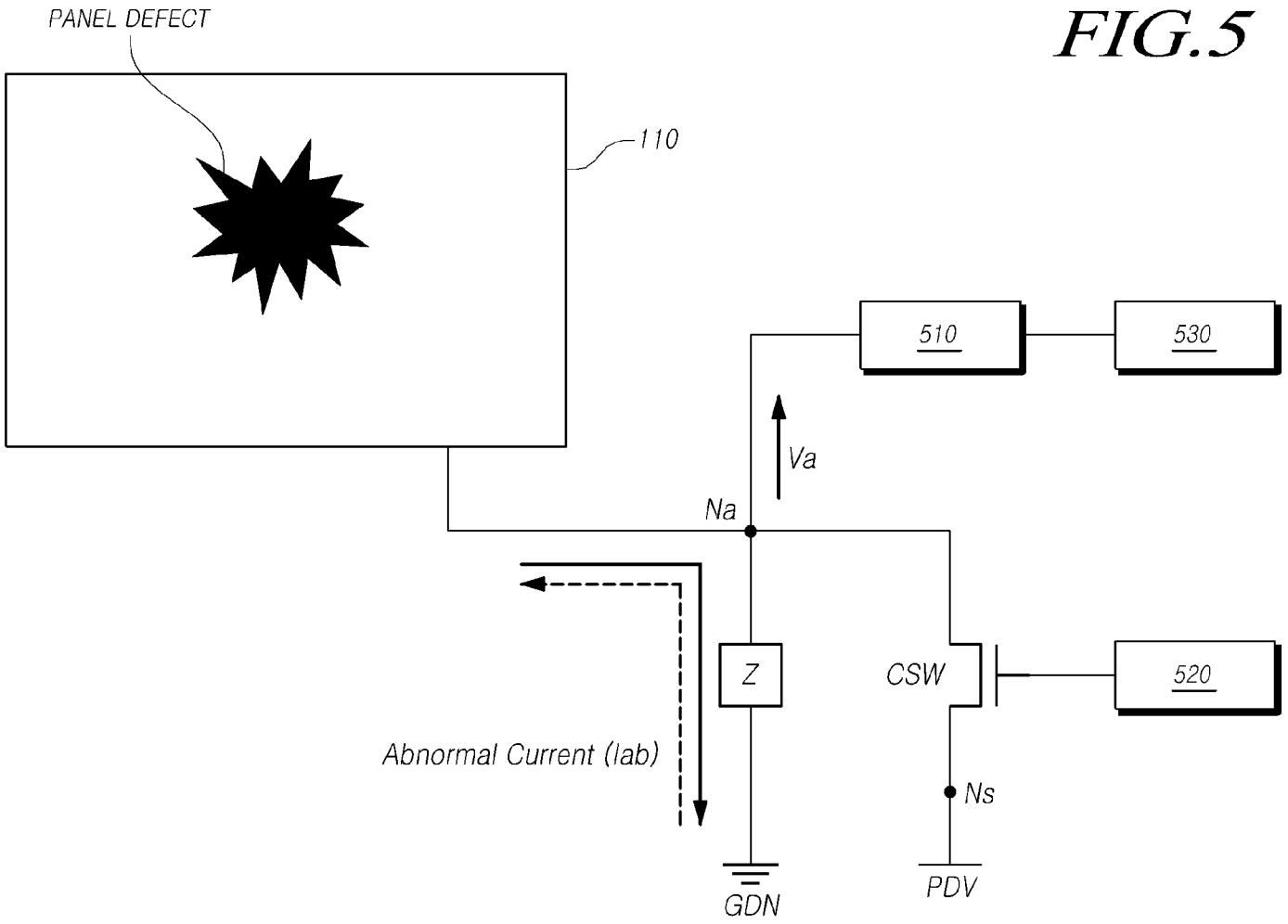
FIG. 5 and FIG. 6 are diagrams schematically illustrating a panel defect detection system according to a type of an impedance element for panel defect detection Z or a sensing scheme (sensing location) type, in a display device according to the present embodiments.
Figure 6:
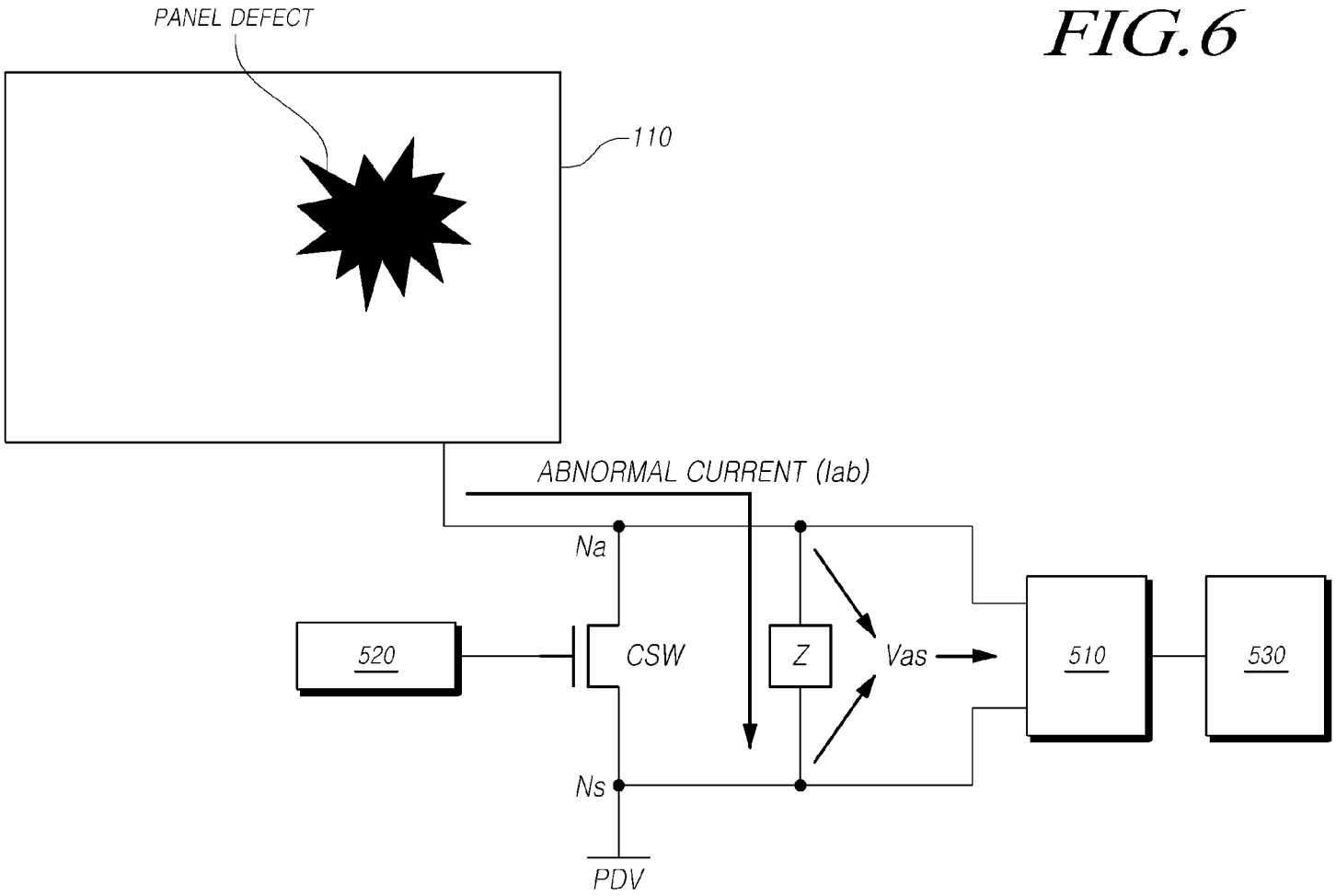

FIG. 5 and FIG. 6 are diagrams schematically illustrating a panel defect detection system according to a type of an impedance element for panel defect detection Z or a sensing scheme (sensing location) type, in a display device 100 according to the present embodiments.

Referring to FIG. 5 and FIG. 6, a panel defect detection system included in the display device 100 according to the present embodiments may include a control switching element CSW electrically connected between an application node Na in which a voltage PDV used for driving the display panel 110 is applied to the display panel 110 and a supply node Ns that supplies the voltage for being applied to the display panel 110, and a sensing module 510 for sensing a current flowing through the application node or a voltage according to the current when the control switching element CSW is turned-off.

Here, a situation where the control switching element CSW is off may mean a situation (condition) where a panel defect may be detected while the display panel 110 in being driven.

In addition, the situation where the control switching element CSW is off is a situation where no current is allowed to flow to the application node Na in the display panel 110 if no panel defect exists and an error component (e.g., leakage current and so on) is not considered.

Therefore, in the situation where the control switching element CSW is off, a current flowing through the application node having a voltage PDV used for driving the display panel 110, being applied to the display panel 110 may correspond to "an abnormal current Iab".

In the situation where the control switching element CSW is off, a leakage current flowing through the application node having a voltage PDV used for driving the display panel 110, being applied to the display panel 110 may occur.

In further consideration of a leakage current component, in the situation where the control switching element CSW is off, only a small amount of current corresponding to the size of the leakage current is allowed to flow through the application node Na if no panel defect exists.

Accordingly, in the situation where the control switching element CSW is off, a current flowing through the application node Na may be considered as "a normal current" corresponding to the leakage current when the current flowing through the application node Na has a current value lower than a threshold current value. When the current flowing through the application node Na has a current value exceeding a threshold current value, the current flowing through the application node Na may be considered as "an abnormal current Iab".

As described above, in an off-situation of the control switching element CSW electrically connected between the application node Na in which a voltage PDV used for driving the display panel 110 is applied to the display panel 110 and the supply node Ns that supplies the voltage for being applied to the display panel 110, that is, a situation where no abnormal current is allowed to occur in the display panel 110, the presence or absence of a panel defect may be quickly and conveniently detected by sensing a current flowing through the application node Na in which a voltage PDV used for driving the display panel 110 is applied to the display panel 110.

According to the description above, for panel defect detection, an environment (a panel defect detection environment) capable of detecting an abnormal current Iab in the display panel 110 is created by turning off the control switching element CSW electrically connected between the application node Na in which a voltage PDV used for driving the display panel 110 is applied to the display panel 110 and the supply node Ns that supplies the voltage for being applied to the display panel 110.

Here, the abnormal current Iab may have even a slightly larger current value than 0[A], or a current value exceeding a threshold current value in consideration of a normal error component such as a leakage current.

In the panel defect detection environment, a screen for panel defect detection is displayed on the display panel 110.

Therefore, the data driver 120, for example, outputs a data voltage for panel defect detection to data lines connected to multiple subpixels in the display panel 110, respectively.

Here, the screen for panel defect detection may be a black screen, etc., and a data voltage for panel defect detection, which is for displaying the screen for panel defect detection, may be a predefined black data voltage, etc.

At the timing of panel defect detection, the controller 140 may output data for panel defect detection to the data driver 120, and the data driver 120 may convert the received data for panel defect detection to a data voltage for panel defect detection to output the converted data voltage.

The sensing module 510 may sense whether an abnormal current Iab has occurred in the display panel 110 when the data voltage for panel defect detection is output in the data driver 120.

According to the description above, the presence or absence of a panel defect may be detected by sensing an abnormal current Iab occurring in the display panel 110 while a screen for panel defect detection, such as a black screen is being displayed, through data voltage control.

Referring to FIG. 5 and FIG. 6, the panel defect detection system included in the display device 100 according to the present embodiments may further include a control module 520 for controlling turn-on or turn-off of the control switching element CSW.

When the control switching element CSW is implemented in a transistor, the control module 520 may control turn-on or turn-off of the control switching element CSW by supplying a gate signal (see FIG. 7) corresponding to a control signal to a gate node of the control switching element CSW.

A panel defect detection environment for panel defect detection may be effectively set, using the control module 520.

Referring to FIG. 5 and FIG. 6, the panel defect detection system in the display device 100 according to the present embodiments may further include an impedance element for panel defect detection Z, an end of which is connected to the application node Na.

The impedance element for panel defect detection Z performs a function to convert an abnormal current Iab to a voltage component.

As illustrated in FIG. 5, the impedance element for panel defect detection Z has an end connected to the application node Na, but has the other end that may be connected to a ground voltage node GDN.

In this case, the impedance element for panel defect detection Z may be an element allowing an occurrence of an impedance change by current at the timing of panel defect detection such that abnormal current sensing (panel defect detection) may be performed by a voltage sensing scheme.

For example, the impedance element for panel defect detection Z may be a capacitor type impedance element, and may be a resistor type impedance element in some cases.

Referring to FIG. 5, when an abnormal current Iab occurs in the display panel 110 due to a panel defect, the control switching element CSW is off, and the abnormal current Iab introduced into the application node Na thus flows to the impedance element for panel defect detection Z in the display panel 110.

Accordingly, impedance in the impedance element for panel defect detection Z changes, and the voltage Va of the application node Na thus changes.

The sensing module 510 may sense the voltage Va of the application node Na and thus sense whether an abnormal current Iab has occurred or the size of the current in the display panel 110.

Meanwhile, as illustrated in FIG. 6, the impedance element for panel defect detection Z has an end connected to the application node Na, but has the other end that may be connected to the ground supply node Ns.

In this case, the impedance element for panel defect detection Z may be an impedance element for sensing an abnormal current (panel defect detection) using a scheme for measuring a potential difference Vas between the application node Na and the supply node Ns.

In the present specification, the potential difference Vas between the application node Na and the supply node Ns may be a voltage (Va-Vs) obtained by subtracting the voltage Vs of the supply node Ns from the voltage Va of the application node Na when the application node Na has a higher potential between the application node Na and the supply node Ns, and may be a voltage (Vs-Va) obtained by subtracting the voltage Va of the application node Na from the voltage Vs of the supply node Ns when the supply node Ns has a higher potential between the application node Na and the supply node Ns.

For an example, the impedance element for panel defect detection Z may be a resistor type impedance element, and may be a capacitor type impedance element in some cases.

Referring to FIG. 6, when an abnormal current Iab occurs in the display panel 110 due to the presence of a panel defect, the control switching element CSW is turned-off, and the abnormal current Iab introduced to the application node Na may thus flow to the impedance element for panel defect detection Z, in the display panel 110.

Accordingly, the potential difference Vas between the application node Na and the supply node Ns occurs by the impedance element for panel defect detection Z.

The sensing module 510 senses the potential difference Vas between the application node Na and the supply node Ns, and may thus sense whether an abnormal current Iab has occurred in the display panel 110 and the size thereof.

Referring to FIG. 5 and FIG. 6, the sensing module 510 may sense a current flowing through to the application node Na, by a voltage sensing scheme.

This sensing module 510 may sense the voltage Va of the application node Na, an impedance of the impedance element for panel defect detection Z, or a potential difference Vas between the application node Na and the supply node Ns, so as to sense a current flowing through the application node Na when the control switching element CSW is turned-off.

In other words, in a situation where no current is allowed to flow or in a situation where only an appropriate level of a micro-current is allowed to flow although a current flow is allowed, the sensing module 510 may accurately sense, using a voltage sensing scheme, a current that is generated in the display panel 110 and flows to the application node Na, by converting even the micro-current generated in the display panel 110 to a voltage component, through the impedance element for panel defect detection Z. Accordingly, a panel defect may be accurately and effectively detected.

Meanwhile, referring to FIG. 5 and FIG. 6, when the control switching element CSW is turned-off, the panel defect detection system in the display device 100 according to the present embodiments may further include a panel defect countermeasure processing unit 530 for storing a panel defect code, storing panel defect location information, or outputting a panel defect countermeasure control signal (e.g., a power off control signal, etc.), by considering that an abnormal current Iab has occurred through the application node Na, when the voltage Va of the application node Na is equal to or greater than a threshold voltage, the impedance of the impedance element Z of panel defect detection is equal to or greater than a threshold impedance, or a potential difference Vas between the application node Na and the supply node Ns is equal to or greater than a threshold potential difference.

Through the panel defect countermeasure processing unit 530, a situation where a part of or the entire display panel 110 is burned due to a panel defect may be prevented in advance by performing a quick countermeasure process for the panel defect.

Meanwhile, each of elements Na, Ns, CSW, Z, 510, 520, 530 forming the panel defect detection system included in the display device 100 according to the present embodiments may be arranged in various locations and implemented in various types.

For example, the control switching element CSW may be located on the display panel 110, the source printed circuit board 150, or the control printed circuit board 160.

The sensing module 510 may be located on the source printed circuit board 150 or the control printed circuit board 160, or may be included inside the control module 520, and may be included inside the data driver 120 in some cases.

The application node Na may be located on the display panel 110, and may be located on the source printed circuit board 150 or the control printed circuit board 160.

The supply node Ns may also be located on the display panel 110, located on the source printed circuit board 150 or the control printed circuit board 160, and may be an output terminal of a power supply device (not shown).

The panel defect countermeasure processing unit 530 may be located on the source printed circuit board 150 or the control printed circuit board 160, or may be the controller 140 or an internal module of the controller 140, or may be included inside the control module 520.

The control module 520 may be located on the source printed circuit board 150 or the control printed circuit board 160.

The control module 520 may be implemented in an integrated circuit (IC) or implemented in a control circuit using a semiconductor element.

The control module 520 may be a different module from the controller 140, and may be a controller 140 or an internal module inside the controller 140 in some cases.

As described above, in consideration of the other elements of the display device 100, elements of the panel defect detection system Na, Ns, CSW, Z, 510, 520, 530 may be arranged in various locations and implemented in various forms.

Figure 7:
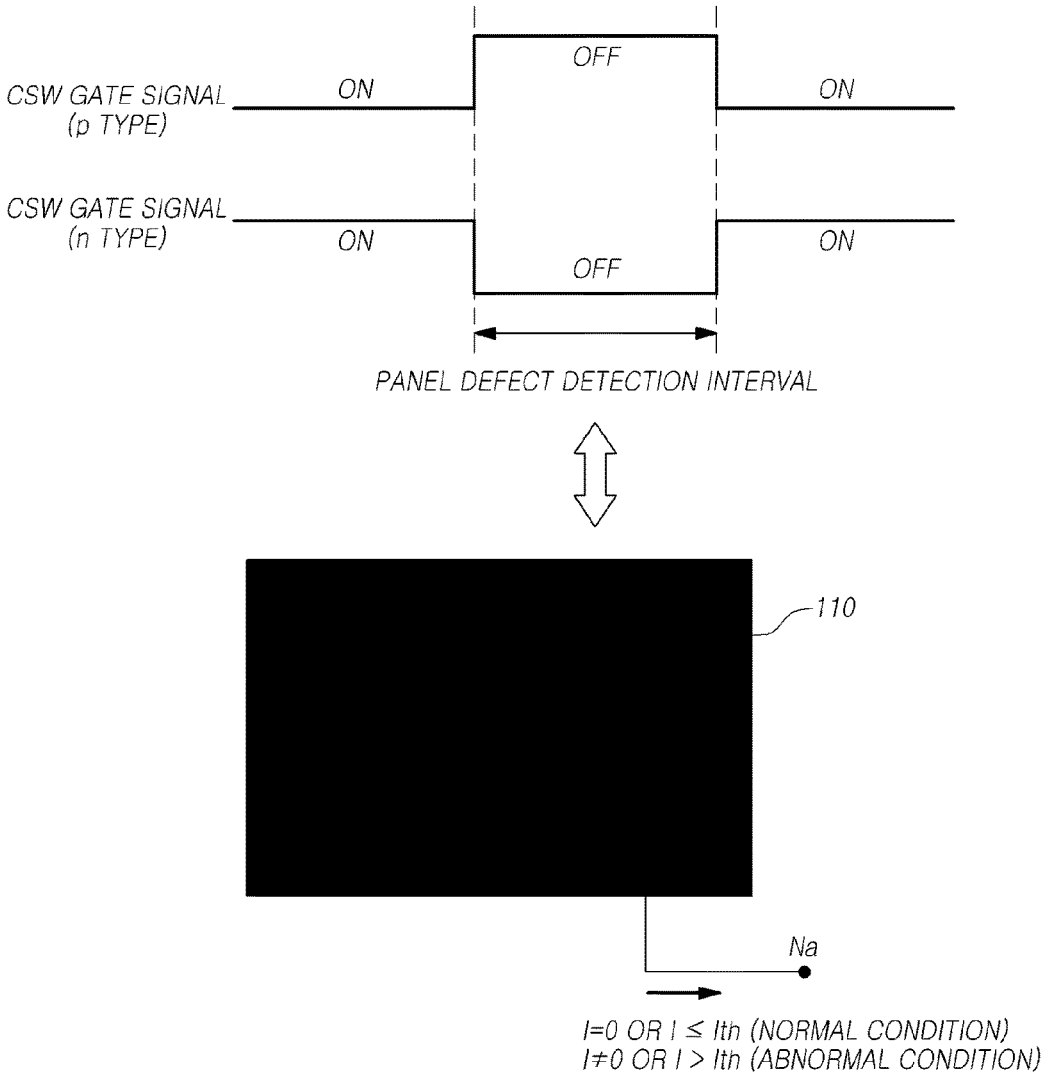
FIG. 7 is a diagram illustrating an operation timing of a control switching element CSW and a panel defect detection timing in a panel defect detection system of a display device according to the present embodiments.

FIG. 7 is a diagram illustrating an operation timing of a control switching element CSW and a panel defect detection timing in a panel defect detection system of a display device 100 according to the present embodiments.

Referring to FIG. 7, the panel defect detection system of the display device 100 according to the present embodiments sets a panel defect detection environment for panel defect detection.

To this end, the panel defect detection system, in a situation where no current occurs in the display panel 110, for example, in a situation where a black screen is displayed, recognizes the situation as a panel defect detection timing so as to set the panel defect detection environment.

Here, the panel defect detection timing (panel defect detection interval) may be an interval in which a screen (e.g., a black screen) having brightness equal to or lower a particular value is displayed, an interval in which a characteristic value of a subpixel is sensed (a black screen may also be displayed in the interval), and an interval in which a screen (e.g., a black screen) having brightness equal to or lower than a particular value is displayed while an image is being driven, or the like.

The panel defect detection timing (panel defect detection internal), for example, may be a black screen display driving interval.

The panel defect detection system, when recognizing a panel defect detection timing, turns off the control switching element CSW to create a situation (panel defect detection environment) where no abnormal current Iab is allowed to flow to the application node Na in the display panel 110 if no panel defect exists, and performs panel defect detection when the panel defect detection environment is set.

To this end, the control switching element CSW may be turned-off by the control module 520 in a situation where no abnormal current is allowed to occur in the display panel 110 when no panel defect exists, that is, a condition where the abnormal current does not occur in the display panel 110 (a condition where no abnormal current is allowed to occur).

Here, even a small amount of current I generated in the display panel 110, i.e., the current I which is not 0 [A], may be an abnormal current Iab.

Alternatively, when a current I having a larger current value than a micro-current value (predefined threshold current value) Ith generated by a normal error component such as a leakage current occurs, this current I may be an abnormal current Iab.

a normal state: $I=0$ or $I \leq Ith$ an abnormal state: $I \neq 0$ or $I > Ith \Rightarrow I = Iab$ In describing a panel defect detection environment from the point of view of a screen displayed on the display panel 110, the panel defect detection environment may be an environment displaying a screen having brightness equal to or lower than a predetermined particular value.

To this end, the control switching element CSW may be turned-off in an interval where a screen having brightness equal to or lower than a predetermined particular value is displayed.

That is, the control switching element CSW may be in an off-state in a black screen display driving interval, and in an on-state in the other normal intervals which are not black screen display driving intervals (normal screen display driving intervals).

As described above, in an interval where no abnormal current occurs in the display panel 110, or an interval where a screen having brightness equal to or lower than a predetermined particular value, at the point of view of the screen, is displayed, an environment and timing capable of easily and accurately detecting the presence or absence of a panel defect may be controlled by controlling the control switching element CSW to be turned-off.

In addition, since the interval where a screen (e.g., a black screen, etc.) having brightness equal to or lower than a predetermined particular value is displayed is set to a panel defect detection interval to detect a panel defect, it is also advantageous not to interrupt a user's viewing at all at the time of panel defect detection.

The control switching element CSW may be implemented in a p type transistor and may be implemented in an n type transistor.

Referring to FIG. 7, the control module 520 may input a gate signal suitable for a control switching element CSW type (n type and p type) to a gate node of a control switching element CSW. However, in the following, for convenience of description, the control switching element CSW is assumed to be implemented in an n type.

As described above, the impedance element for panel defect detection Z may be an element allowing an occurrence of a voltage difference by current at the timing of panel defect detection, such that abnormal current sensing (panel defect detection) may be performed by a voltage sensing scheme.

The impedance element for panel defect detection Z, for example, may be a resistor for panel defect detection Rdet, which has an end connected to the application node Na and the other end connected to the supply node Ns.

As described above, when a resistor type impedance element is suitable for a sensing scheme (a panel defect detection scheme) or a circuit configuration of the panel defect detection system, the resistor for panel defect detection Rdet may be used for the impedance element for panel defect detection Z.

In addition, the impedance element for panel defect detection Z, for another example, may be a capacitor for panel defect detection Cdet, which has an end connected to the application node Na and the other end connected to the ground voltage node GDN or the supply node Ns.

Here, the ground voltage node GDN is a node to which a predefined ground voltage is applied, wherein the predefined ground voltage, for example, may be 0[V] or a voltage slightly smaller or greater than 0[V] (e.g., −1[V], 0.5[V], etc.) and may have the same voltage value as the supply node Ns according to a type and circuit design of a voltage PDV used for driving the display panel 110.

As described above, when a capacitor type impedance element is suitable for a sensing scheme (a panel defect detection scheme) or a circuit configuration of the panel defect detection system, the capacitor for panel defect detection Cdet may be used for the impedance element for panel defect detection Z.

Meanwhile, when the display panel 110 is an organic light emitting display panel, on which multiple subpixels each of which includes an organic light emitting diode (OLED) and a driving transistor DRT for driving the organic light emitting diode (OLED), are arranged, the voltage PDV used for the display panel 110 may be a voltage (e.g., a driving voltage EVDD, etc.) applied to a third node N3 which may be a drain node or source node of the driving transistor DRT, or may be a voltage (e.g., a ground voltage EVES, etc.) capable of being applied to an anode electrode or cathode electrode of the organic light emitting diode (OLED).

As described above, when panel defect detection is performed in an off-situation of the control switching element CSW electrically connected between the application node Na in which a voltage PDV used for driving the display panel 110 is applied to the display panel 110 and the supply node Ns that supplies the voltage for being applied to the display panel 110, a current flowing at a point Na, to which various panel driving voltages PDVs used for driving the display panel 110 are applied, may be sensed so as to detect a panel defect.

In the following, the panel defect detection system will be divided into four types and described, according to a type of a panel driving voltage PDV and a type of an impedance element for panel defect detection Z.

FIG. 8 to FIG. 11 are diagrams simply illustrating four kinds of panel defect detection systems (first, second, third, and fourth panel defect detection systems) according to a type of panel driving voltage PDV and an impedance element Z type for panel defect detection, in a display device 100 according to the present embodiments.

Figure 8:
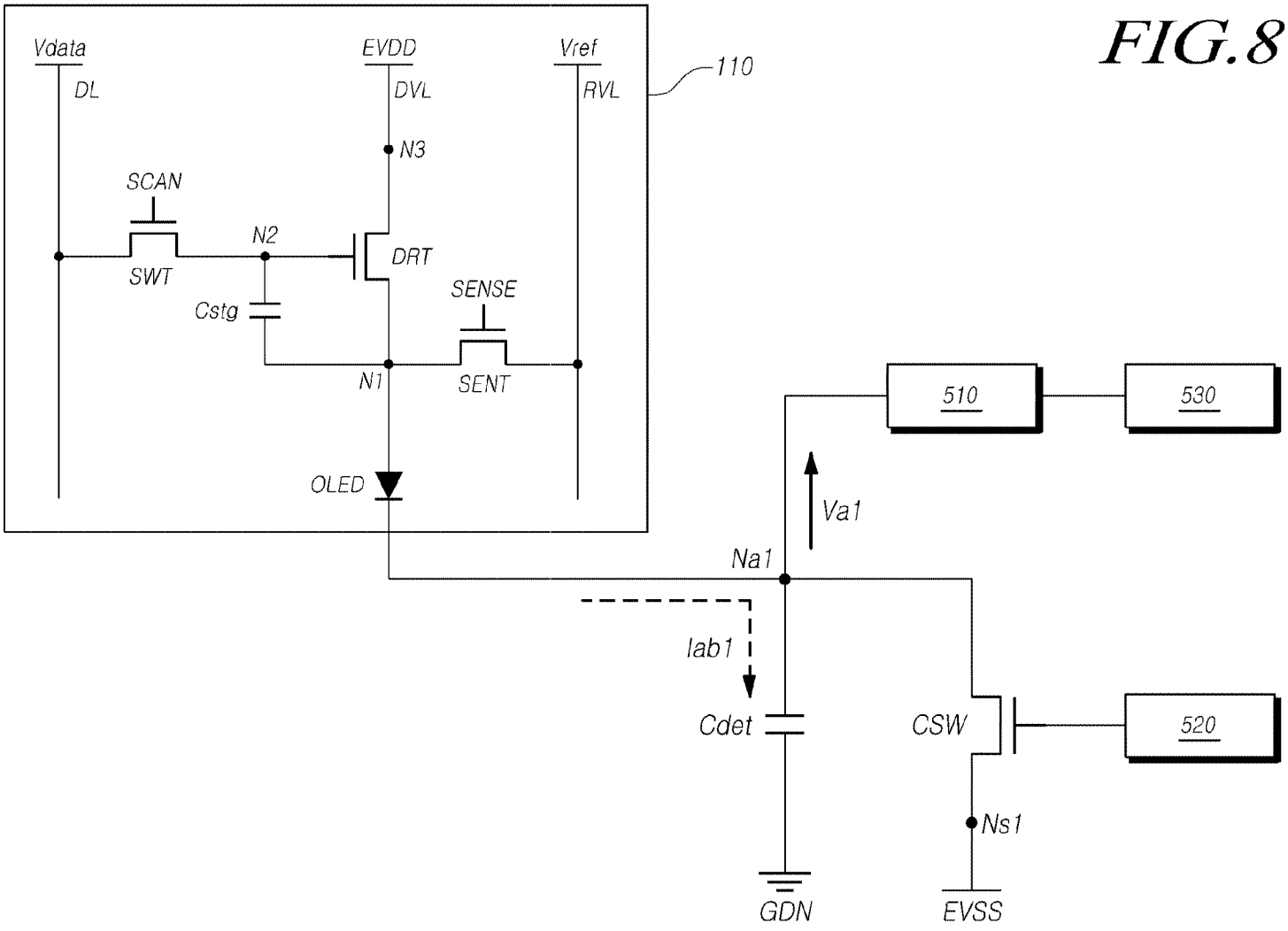
FIG. 8 to FIG. 11 are diagrams simply illustrating four kinds of panel defect detection systems (first, second, third, and fourth panel defect detection systems) according to a type of a panel driving voltage and a type of an impedance element for panel defect detection, in a display device according to the present embodiments.

A first panel defect detection system simply illustrated in FIG. 8 utilizes an application node Na1 having a ground voltage EVSS applied to the display panel 110, as a type of a panel driving voltage PDV, and utilizes a capacitor for panel defect detection Cdet for the impedance element for panel defect detection Z.

Figure 9:
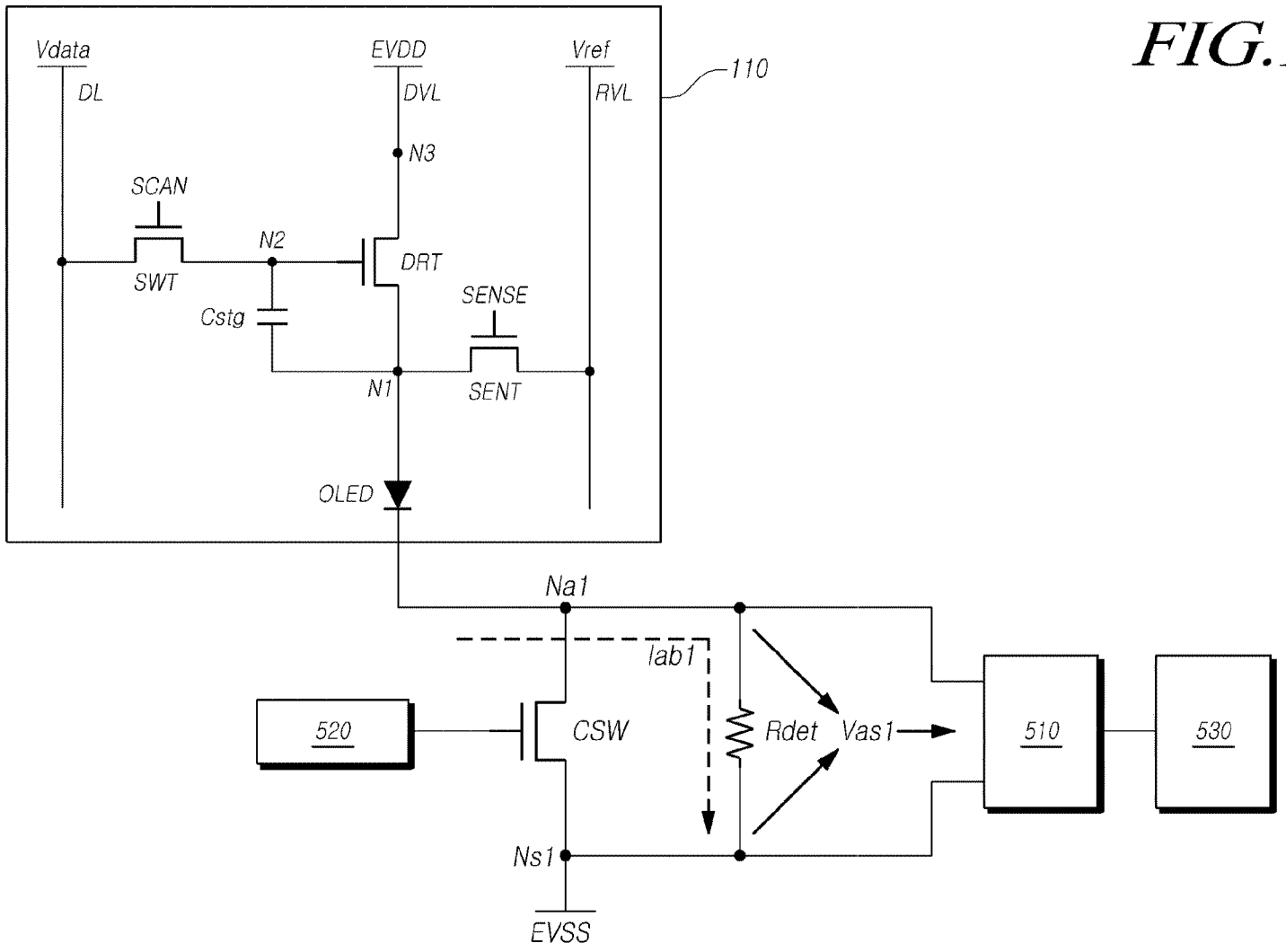

A second panel defect detection system simply illustrated in FIG. 9 utilizes an application node Na1 having a ground voltage EVSS applied to the display panel 110, as a type of a panel driving voltage PDV, and utilizes a resistor for panel defect detection Rdet for the impedance element for panel defect detection Z.

Figure 10:
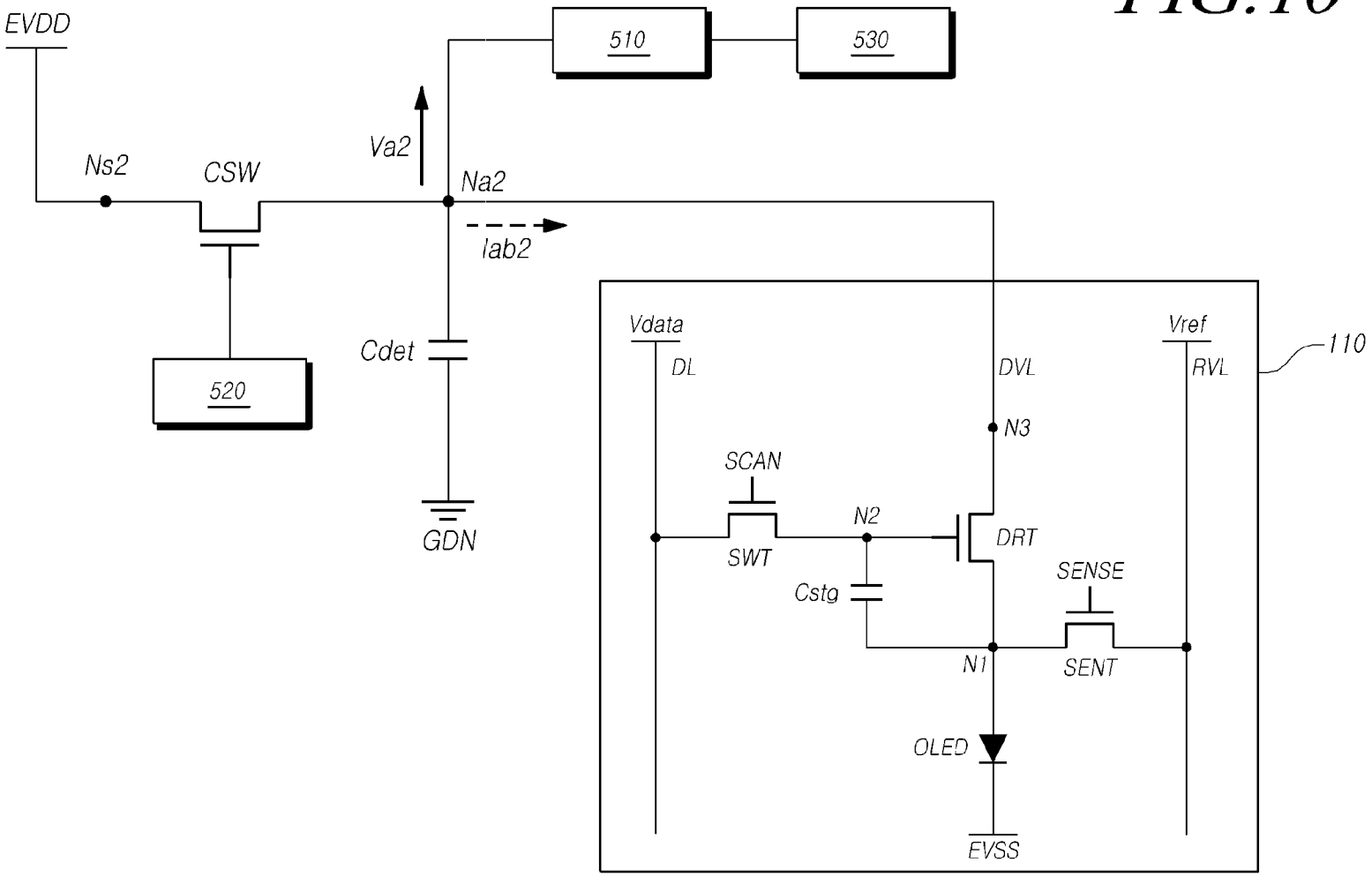

A third panel defect detection system simply illustrated in FIG. 10 utilizes an application node Na2 having a driving voltage EVDD applied to the display panel 110 for another type of a panel driving voltage PDV, and utilizes a capacitor for panel defect detection Cdet for the impedance element for panel defect detection Z.

Figure 11:
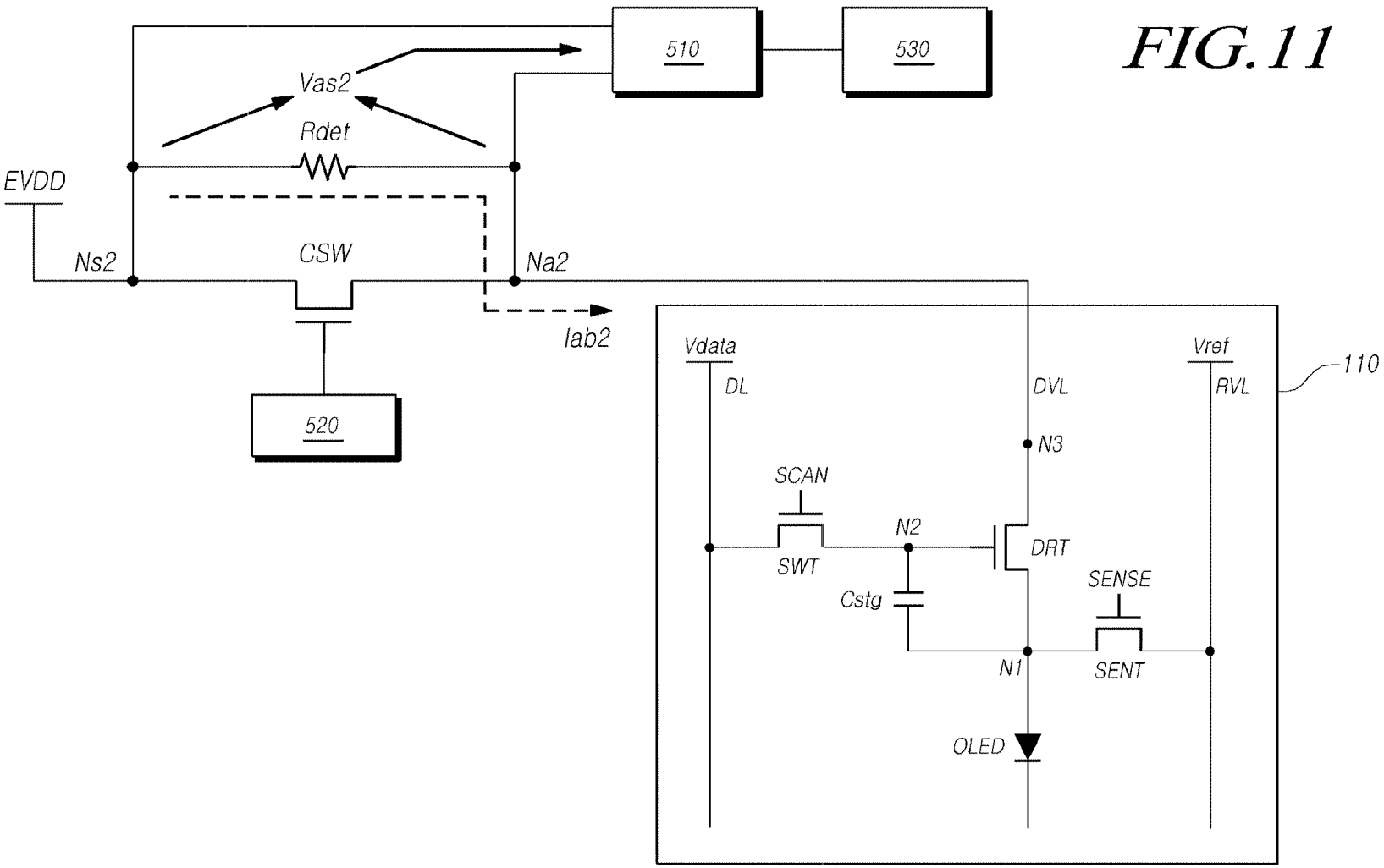

A fourth panel defect detection system simply illustrated in FIG. 11 utilizes an application node Na2 having a driving voltage EVDD applied to the display panel 110 for another type of a panel driving voltage PDV, and utilizes a resistor for panel defect detection Rdet for the impedance element for panel defect detection Z.

Referring to FIG. 8, in the first panel defect detection system, the control switching element CSW may be electronically connected between the application node Na1 in which the ground voltage EVSS is applied to a cathode electrode of an organic light emitting diode (OLED) of each subpixel in the display panel 110 and the supply node Ns1 that supplies the ground voltage EVSS.

Here, the application node Na1 may be on a cathode electrode in the display panel 110 to which the ground voltage EVSS is applied or may be electrically connected to the cathode electrode.

In addition, the ground voltage EVSS is a cathode voltage and a type of a panel driving voltage PDV.

In the first panel defect detection system, the capacitor for panel defect detection Cdet utilized for the impedance element for panel defect detection Z may be electronically connected between the application node Na1 and the ground voltage node GDN.

Here, the supply node Ns1 and the ground voltage node GDN may be an equipotential node when the ground voltage EVSS is configured as a ground voltage.

The control module 520 outputs a control signal to control the control switching element CSW to be turned-off in a panel defect detection interval (a panel defect detection timing), which may be an interval in which a screen (e.g., a black screen) having brightness equal to or lower than a particular value is displayed, an interval in which a subpixel characteristic value is sensed (a black screen may also be displayed in the interval), or an interval in which a screen (e.g., a black screen) having brightness equal to or lower than a particular value is displayed while an image is being driven.

Accordingly, when an abnormal current Iab1 occurs in the display panel 110, the occurred abnormal current Iab1 is unable to flow through the control switching element CSW and charges the capacitor for panel defect detection Cdet.

As the capacitor for panel defect detection Cdet is charged, the voltage Va1 of the application node Na1 increases.

The sensing module 510 may sense the voltage Va1 of the application node Na1 and output the sensed voltage Va1 to the panel defect countermeasure processing unit 530 as a panel defect detection signal, or output the panel defect detection signal indicating the voltage Va1 of the application node Na1 having been increased to the panel defect countermeasure processing unit 530.

Accordingly, the panel defect countermeasure processing unit 530 may receive the panel defect detection signal and recognize whether a panel defect exists so as to perform a predetermined countermeasure process.

Meanwhile, in the first panel defect detection system of FIG. 8, a scheme for sensing the voltage Va1 of the application node Na1 and so on are all the same despite utilizing the resistor for panel defect detection Rdet, which is electrically connected between the application node Na1 and the ground voltage node GDN, instead of utilizing the capacitor for panel defect detection Cdet for the impedance element for panel defect detection Z.

Referring to FIG. 9, in the second panel defect detection system, the control switching element CSW may be electronically connected between the application node Na1 in which the ground voltage EVSS is applied to a cathode electrode of an organic light emitting diode (OLED) of each subpixel in the display panel 110 and the supply node Ns1 that supplies the ground voltage EVSS.

Here, the application node Na1 may be on a cathode electrode in the display panel 110 to which the ground voltage EVSS is applied or may be electrically connected to the cathode electrode.

In addition, the ground voltage EVSS is a cathode voltage and a type of a panel driving voltage PDV.

In the second panel defect detection system, the resistor for panel defect detection Rdet utilized for the impedance element for panel defect detection Z may be electrically connected between the application node Na1 and the supply node Ns1.

The control module 520 outputs a control signal to control the control switching element CSW to be turned-off in a panel defect detection interval (a panel defect detection timing), which may be an interval in which a screen (e.g., a black screen) having brightness equal to or lower than a particular value is displayed, an interval in which a subpixel characteristic value is sensed (a black screen may also be displayed in the interval), or an interval in which a screen (e.g., a black screen) having brightness equal to or lower than a particular value is displayed while an image is being driven.

Accordingly, when an abnormal current Iab1 occurs in the display panel 110, the occurred abnormal current Iab1 is unable to flow through the control switching element CSW and flows through the resistor for panel defect detection Rdet.

Accordingly, a voltage drop occurs and a potential difference Vas1 between both ends of the resistor for panel defect detection Rdet thus occurs.

The sensing module 510 may sense the potential difference Vas1 between both ends of the resistor for panel defect detection Rdet, that is, the potential difference Vas1 between the application node Na1 and the supply node Ns1, and output, to the panel defect countermeasure processing unit 530, the sensed potential difference Vas1 as a panel defect detection signal, or output, to the panel defect countermeasure processing unit 530, the panel defect detection signal indicating the potential difference Vas1 between both ends of the resistor for panel defect detection Rdet having occurred.

Accordingly, the panel defect countermeasure processing unit 530 may receive the panel defect detection signal and recognize whether a panel defect exists so as to perform a predetermined countermeasure process.

Referring to FIG. 10, in the third panel defect detection system, the control switching element CSW may be electrically connected between the application node Na2 in which a driving voltage EVDD which is another type of a panel driving voltage PDV is applied to a third node N3 which may be a drain node or source node of the driving transistor DRT of each subpixel in the display panel 110 and the supply node Ns2 that supplies the driving voltage EVDD.

Here, the application node Na1 may be on a driving voltage line DVL in the display panel 110 or may be electrically connected with the driving voltage line DVL.

In the third panel defect detection system, the capacitor for panel defect detection Cdet utilized for the impedance element for panel defect detection Z may be electrically connected between the application node Na2 and the ground voltage node GDN.

The control module 520 outputs a control signal to control the control switching element CSW to be turned-off in a panel defect detection interval (a panel defect detection timing), which may be an interval in which a screen (e.g., a black screen) having brightness equal to or lower than a particular value is displayed, an interval in which a subpixel characteristic value is sensed (a black screen may also be displayed in the interval), or an interval in which a screen (e.g., a black screen) having brightness equal to or lower than a particular value is displayed while an image is being driven.

Accordingly, when an abnormal current Iab2 occurs in the display panel 110, the occurred abnormal current Iab2 is unable to flow through the control switching element CSW and charges the capacitor for panel defect detection Cdet.

As the capacitor for panel defect detection Cdet is charged, the voltage Va2 of the application node Na2 increases.

The sensing module 510 may sense the voltage Va2 of the application node Na2 and output the sensed voltage Va2 to the panel defect countermeasure processing unit 530 as a panel defect detection signal, or output the panel defect detection signal indicating the voltage Va2 of the application node Na2 having been increased to the panel defect countermeasure processing unit 530.

Accordingly, the panel defect countermeasure processing unit 530 may receive the panel defect detection signal and recognize whether a panel defect exists so as to perform a predetermined countermeasure process.

Meanwhile, in the third panel defect detection system of FIG. 10, a scheme for sensing the voltage Va2 of the application node Na2 and so on are all the same despite utilizing the resistor for panel defect detection Rdet, which is electrically connected between the application node Na2 and the ground voltage node GDN, instead of utilizing the capacitor for panel defect detection Cdet for the impedance element for panel defect detection Z.

Referring to FIG. 11, in the fourth panel defect detection system, the control switching element CSW may be electrically connected between the application node Na2 in which a driving voltage EVDD which is another type of a panel driving voltage PDV is applied to a third node N3 which may be a drain node or source node of the driving transistor DRT of each subpixel in the display panel 110 and the supply node Ns2 that supplies the driving voltage EVDD.

Here, the application node Na2 may be on a driving voltage line DVL in the display panel 110 or may be electrically connected with the driving voltage line DVL.

In the fourth panel defect detection system, the resistor for panel defect detection Rdet utilized for the impedance element for panel defect detection Z may be electrically connected between the application node Na2 and the supply node Ns2.

The control module 520 outputs a control signal to control the control switching element CSW to be turned-off in a panel defect detection interval (a panel defect detection timing), which may be an interval in which a screen (e.g., a black screen) having brightness equal to or lower than a particular value is displayed, an interval in which a subpixel characteristic value is sensed (a black screen may also be displayed in the interval), or an interval in which a screen (e.g., a black screen) having brightness equal to or lower than a particular value is displayed while an image is being driven.

Accordingly, when an abnormal current Iab2 occurs in the display panel 110, the occurred abnormal current Iab2 is unable to flow through the control switching element CSW and flows through the resistor for panel defect detection Rdet.

Accordingly, a voltage drop occurs and a potential difference Vas2 between both ends of the resistor for panel defect detection Rdet thus occurs.

The sensing module 510 may sense the potential difference Vas2 between both ends of the resistor for panel defect detection Rdet, that is, the potential difference Vas2 between the application node Na2 and the supply node Ns2, and output, to the panel defect countermeasure processing unit 530, the sensed potential difference Vas2 as a panel defect detection signal, or output, to the panel defect countermeasure processing unit 530, the panel defect detection signal indicating the potential difference Vas2 between both ends of the resistor for panel defect detection Rdet having occurred.

Accordingly, the panel defect countermeasure processing unit 530 may receive the panel defect detection signal and recognize whether a panel defect exists so as to perform a predetermined countermeasure process.

The sensing module 510, the control module 520, etc., in the panel defect detection system described above may be implemented in various types.

In addition, the panel defect detection system may include an additional circuit and so on according to an additional function (e.g., a subpixel characteristic value sensing, a compensation function, etc.) of the display device 100.

In the following, examples of various implementations for the first, second, third, and fourth panel defect detection systems simply described above will be described, respectively.

FIG. 12 to FIG. 21 are examples of implementation of a first panel defect detection system according to the present embodiments.

Figure 12:
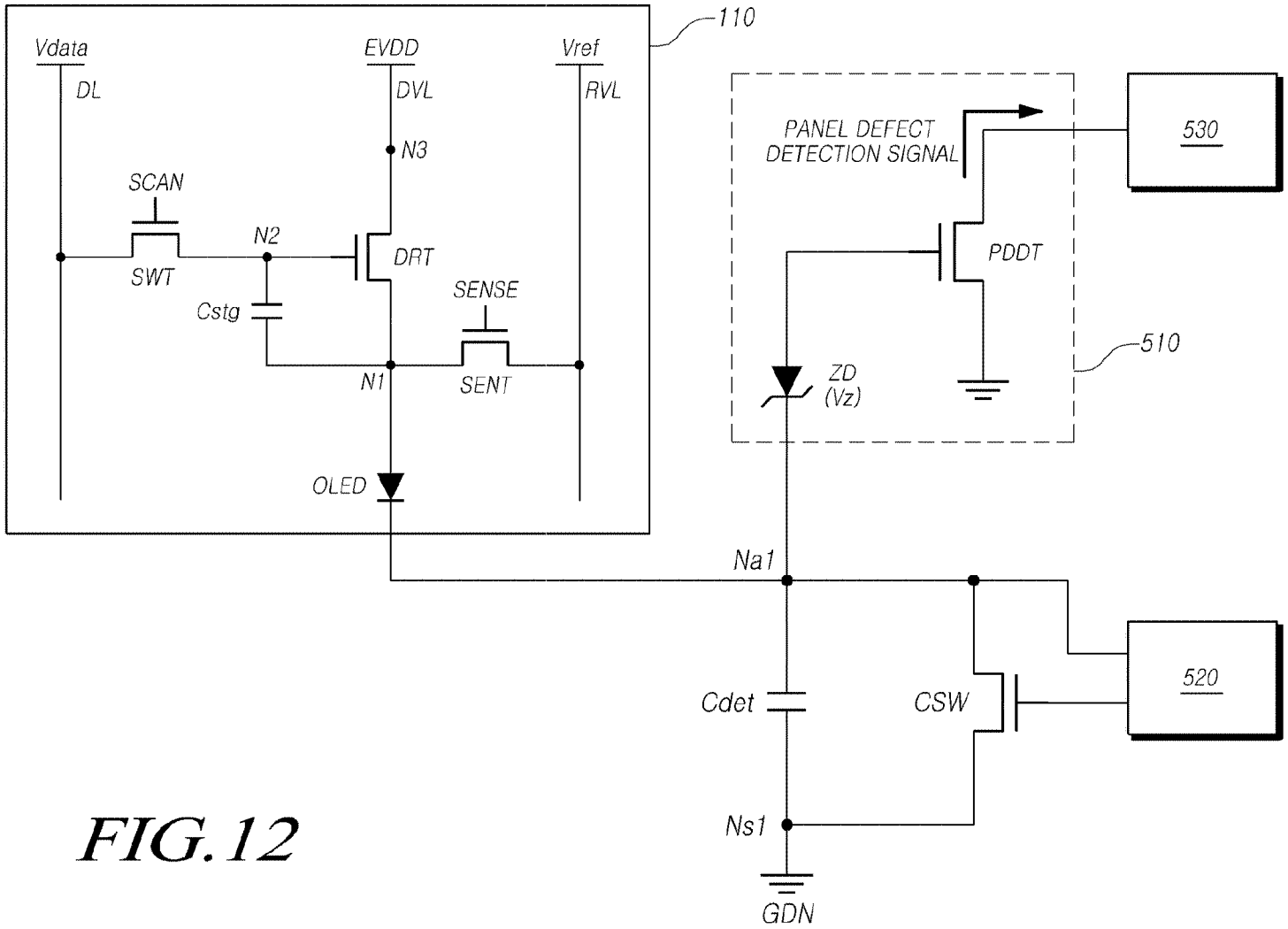
FIG. 12 to FIG. 21 are examples of implementation of a first panel defect detection system according to the present embodiments.

Referring to FIG. 12, in the first panel defect detection system that utilizes the application node Na1 in which the ground voltage EVSS is applied to the display panel 110, as a type of a panel driving voltage PDV, and utilizes the capacitor for panel defect detection Cdet for the impedance element for panel defect detection Z, the sensing module 510 may include a panel defect detection transistor PDDT that is turned-on according to a change in the voltage Va1 of the application node Na1 and outputs a panel defect detection signal, and a Zener diode ZD connected between a gate node of the panel defect detection transistor PDDT and the application node Na1.

When a panel defect exists, an abnormal current Iab1 occurred in the display panel 110 is introduced to the application node Na1, charges the capacitor for panel defect detection Cdet, and increases the voltage Va1 of the application node Na1.

When the voltage Va1 of the application node Na1 becomes equal to or greater than a Zener voltage Vz that is a characteristic value of a Zener diode ZD, the voltage of the gate node of the panel defect detection transistor PDDT also becomes equal to or greater than the Zener voltage Vz so that the panel defect detection transistor PDDT is turned-on.

Here, the Zener diode ZD may be required to be designed to have a Zener voltage Vz capable of turning on the panel defect detection transistor PDDT.

When the panel defect detection transistor PDDT is turned-on, the panel defect detection transistor PDDT may output a panel defect detection signal to the panel defect countermeasure processing unit 530.

Here, when a drain node or source node of the panel defect detection transistor PDDT is assumed to be connected to the ground voltage node, the panel defect detection transistor PDDT, when turned-on, may output a panel defect detection signal corresponding to the ground voltage to the source node or the drain node.

Accordingly, the panel defect countermeasure processing unit 530 may assume that a panel defect exists when a voltage of a point to which the panel defect detection signal is input is in a high level, and the voltage of the point to which the panel defect detection signal is input decreases to the ground voltage (a low level voltage) by inputting the panel defect detection signal corresponding to the ground voltage, and perform a countermeasure process corresponding thereto.

As illustrated in FIG. 12, the sensing module 510 may be implemented in a low price and is easily implemented on the source printed circuit board 150, the control printed circuit board 160, or the like, by configuring the sensing module 510 as a circuit including the panel defect detection transistor PDDT, the Zener diode ZD, etc.

In FIG. 12, the ground voltage EVSS applied to the supply node Ns is assumed to be the ground voltage.

Figure 13:
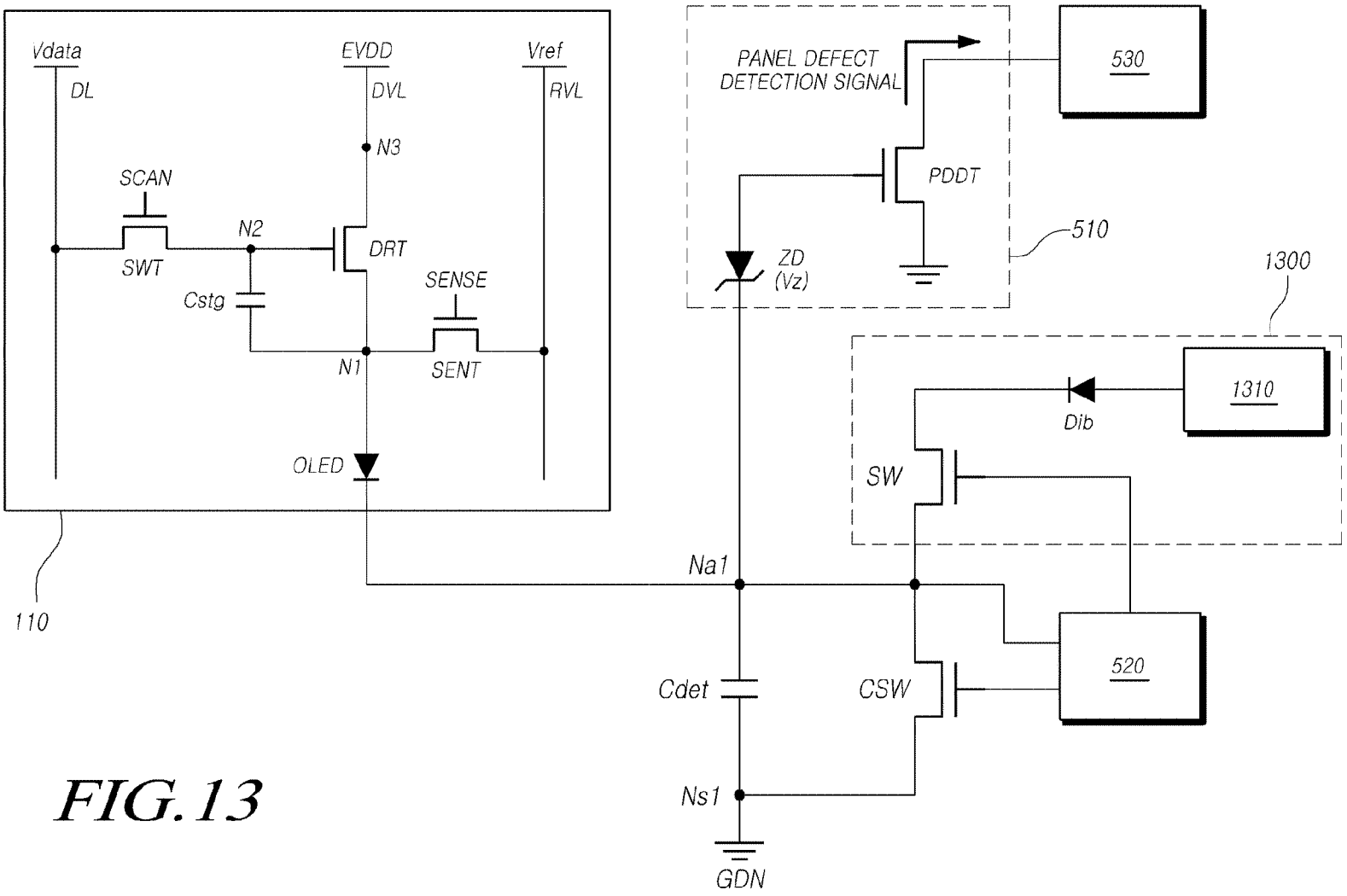

FIG. 13 is a diagram illustrating a case of adding a subpixel characteristic value sensing related circuit 1300 to the first panel defect detection system of FIG. 2 when a display device 100 according to the present embodiments has a subpixel characteristic value sensing and compensating function.

Referring to FIG. 13, when the display panel 110 is an organic light emitting display panel, on which multiple subpixels each of which includes an organic light emitting diode (OLED) and a driving transistor DRT for driving the organic light emitting diode (OLED), are arranged, the subpixel characteristic value sensing related circuit 1300 may include a power supply unit 1310 that supplies the ground voltage EVSS corresponding to a reverse voltage required for subpixel characteristic value sensing driving to the application node Na1 during an interval (subpixel characteristic value sensing interval) for measuring a characteristic value of the driving transistor DRT, a switching element that is turned-on during an interval for measuring a characteristic value of the driving transistor DRT and electronically connects the application node Na1 with the power supply unit 1310, and so on.

The described power supply unit 1310, for example, may be implemented in a DC-DC converter that may enable only current sourcing and suppress current sinking.

The switching element SW included in the subpixel characteristic value sensing related circuit 1300 may be controlled by the control module 520.

At the time of subpixel characteristic value sensing driving, the switching element SW has been turned-on and the control switching element CSW has been turned-off.

At the time of subpixel characteristic value sensing driving through the subpixel characteristic value sensing related circuit 1300, a panel defect may be detected when a screen having brightness equal to or lower than a particular value like a black screen, etc.

Referring to FIG. 13, in the subpixel characteristic value sensing related circuit 1300, an inverse current prevention diode Dib may be electrically connected between the power supply unit 1310 and the switching element SW at the time of subpixel characteristic value sensing driving.

An inverse current prevention function may be provided by an inverse current prevention circuit included in the power supply unit 1310 without the inverse current prevention diode Dib.

According to described above, at the time of subpixel characteristic value sensing driving, subpixel characteristic value sensing and panel defect detection may be accurately performed by preventing an inverse current from entering in the power supply unit 1310.

Figure 14:
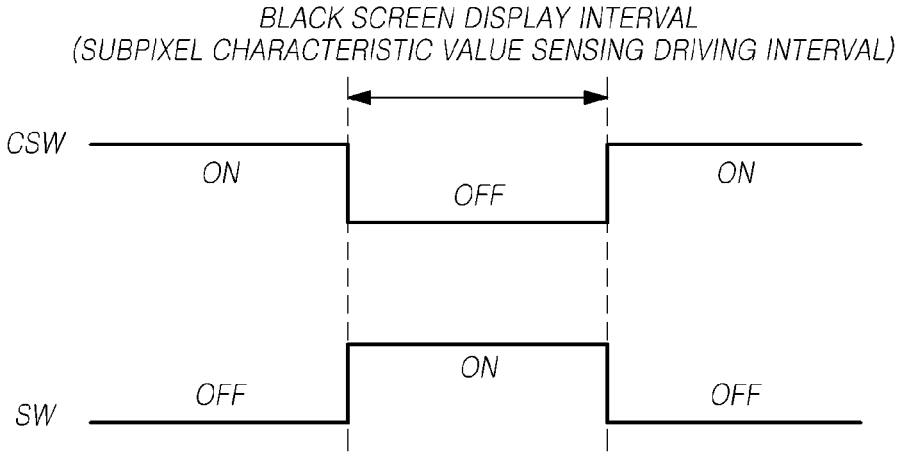

FIG. 14 is an operation timing diagram of the control switching element CSW and switching element SW included in and the subpixel characteristic value sensing related circuit 1300, in FIG. 13.

Referring to FIG. 14, the switching element SW included in the subpixel characteristic value sensing related circuit 1300 may be in an on-state when the control switching element CSW is in an off-state for panel defect detection, in a subpixel characteristic value sensing driving interval corresponding to a black screen display interval in which a screen (e.g., a black screen) having brightness equal to or lower than a particular value is displayed.

Referring to FIG. 14, the control switching element CSW may be in an on-state and the switching element SW included in the subpixel characteristic value sensing related circuit 1300 may be in an off-state in an interval other than a subpixel characteristic value sensing driving interval corresponding to a black screen display interval.

Figure 15:
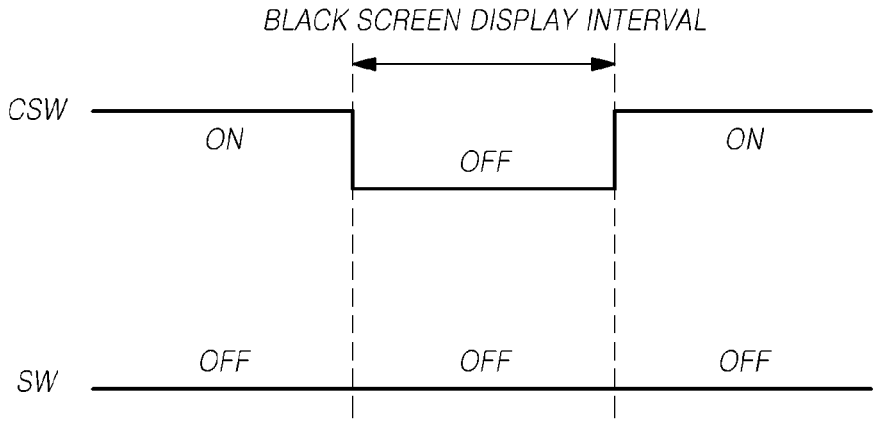

FIG. 15 is another operation timing diagram of the control switching element CSW and switching element SW included in and the subpixel characteristic value sensing related circuit 1300, in FIG. 13.

Referring to FIG. 15, in a black screen display interval (the interval may be a normal screen display driving interval displaying a black screen) in which a screen (e.g., a black screen) having brightness equal to or lower than a particular value is displayed, the switching element SW included in the subpixel characteristic value sensing related circuit 1300 may also be on an off-state when the control switching element CSW is in an off-state for panel defect detection.

Referring to FIG. 15, in an interval other than a black screen display interval (the interval may be a normal screen display driving interval displaying a black screen), the control switching element CSW may be in an on-state for panel defect detection and the switching element SW included in the subpixel characteristic value sensing related circuit 1300 may be in an off-state.

Figure 16:
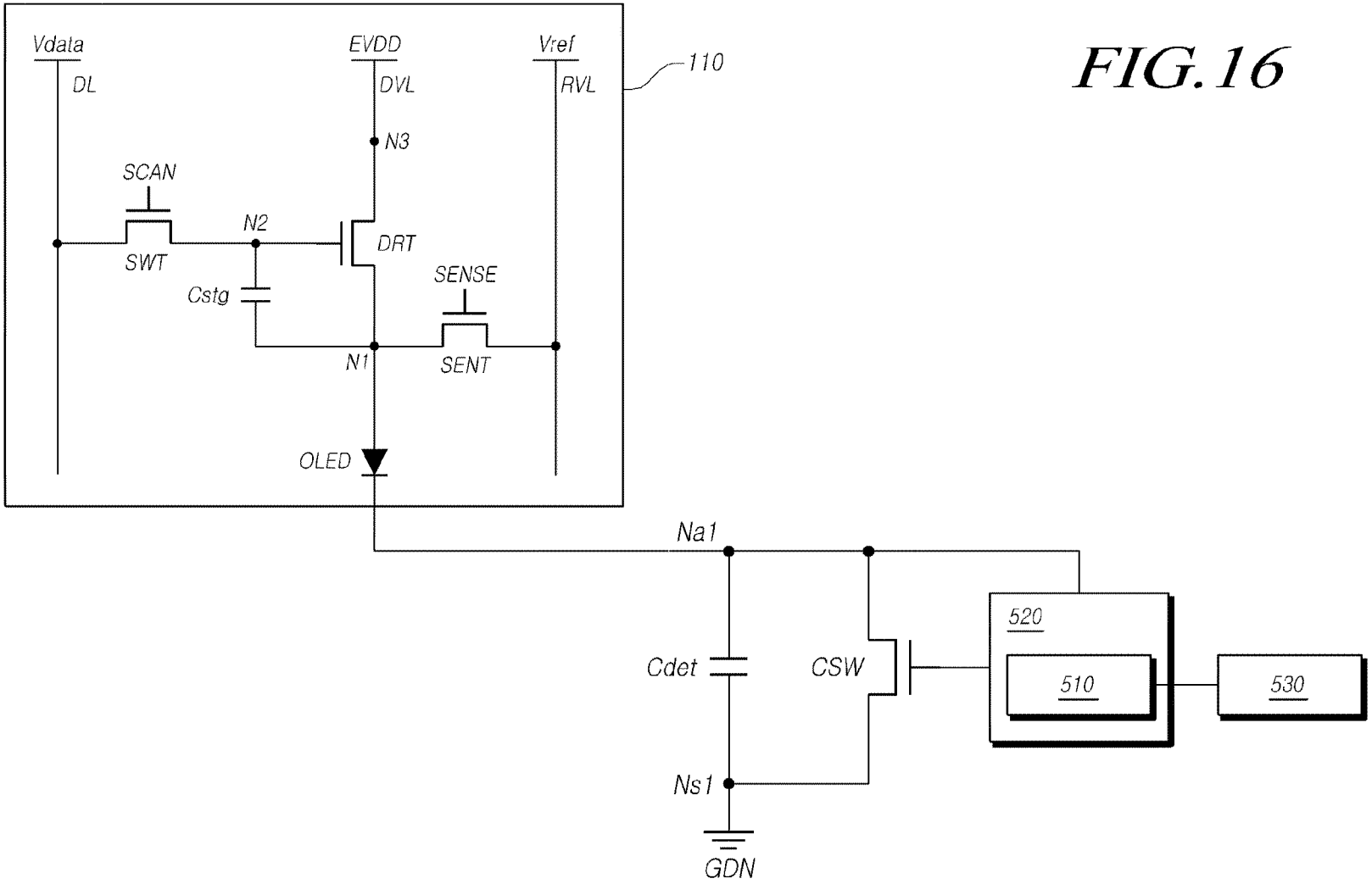
Figure 17:
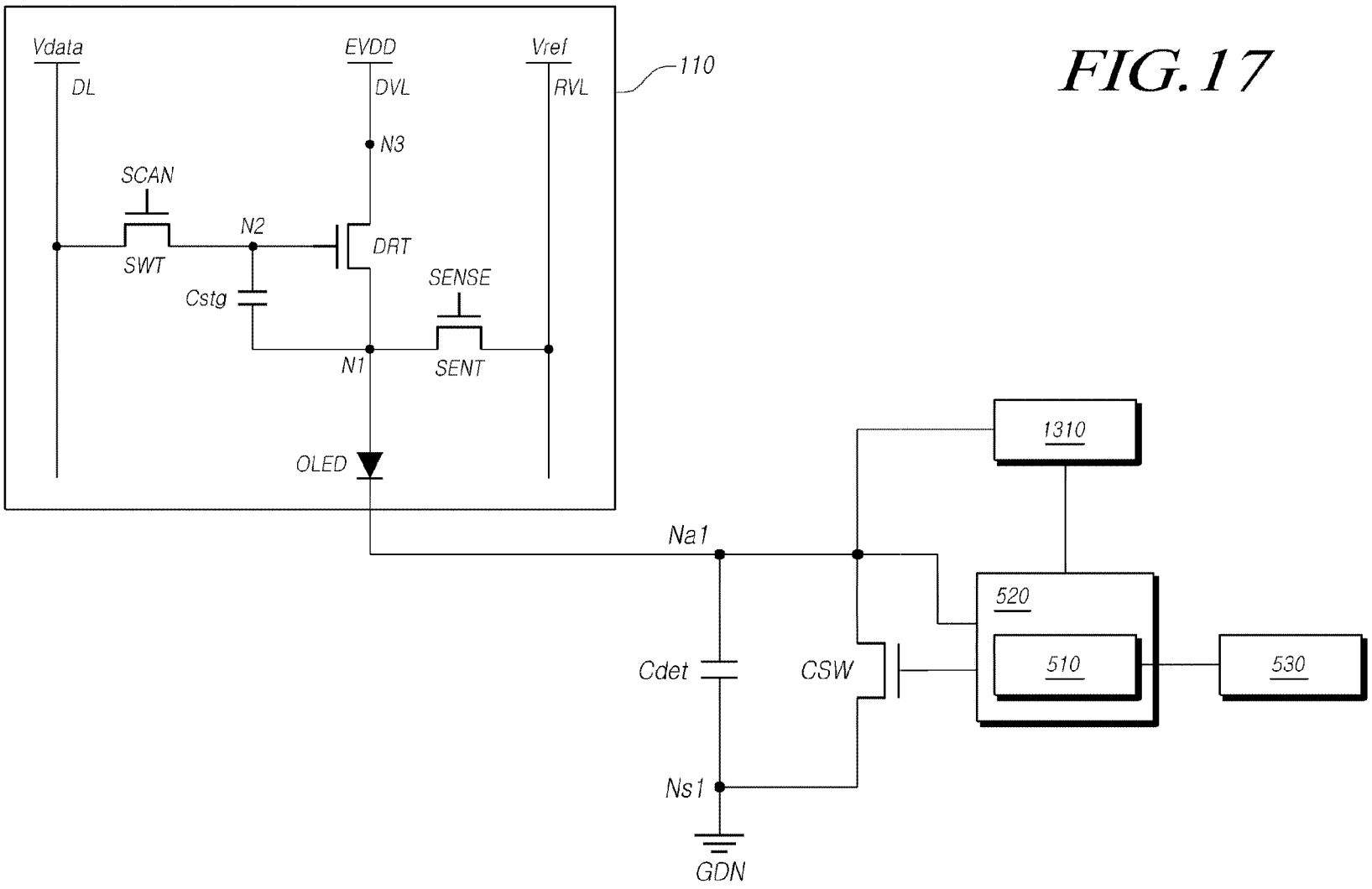
Figure 18:
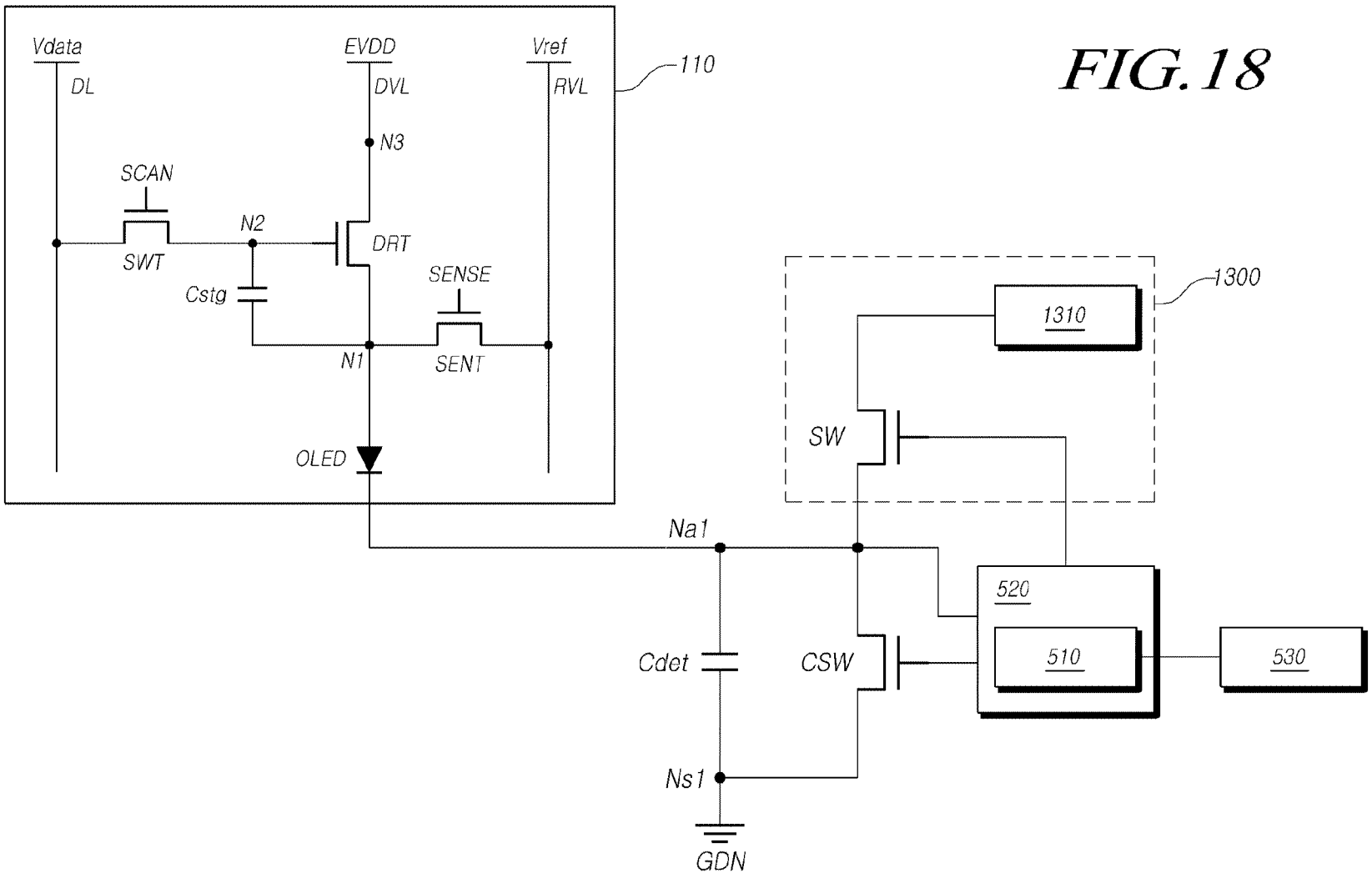
Figure 19:
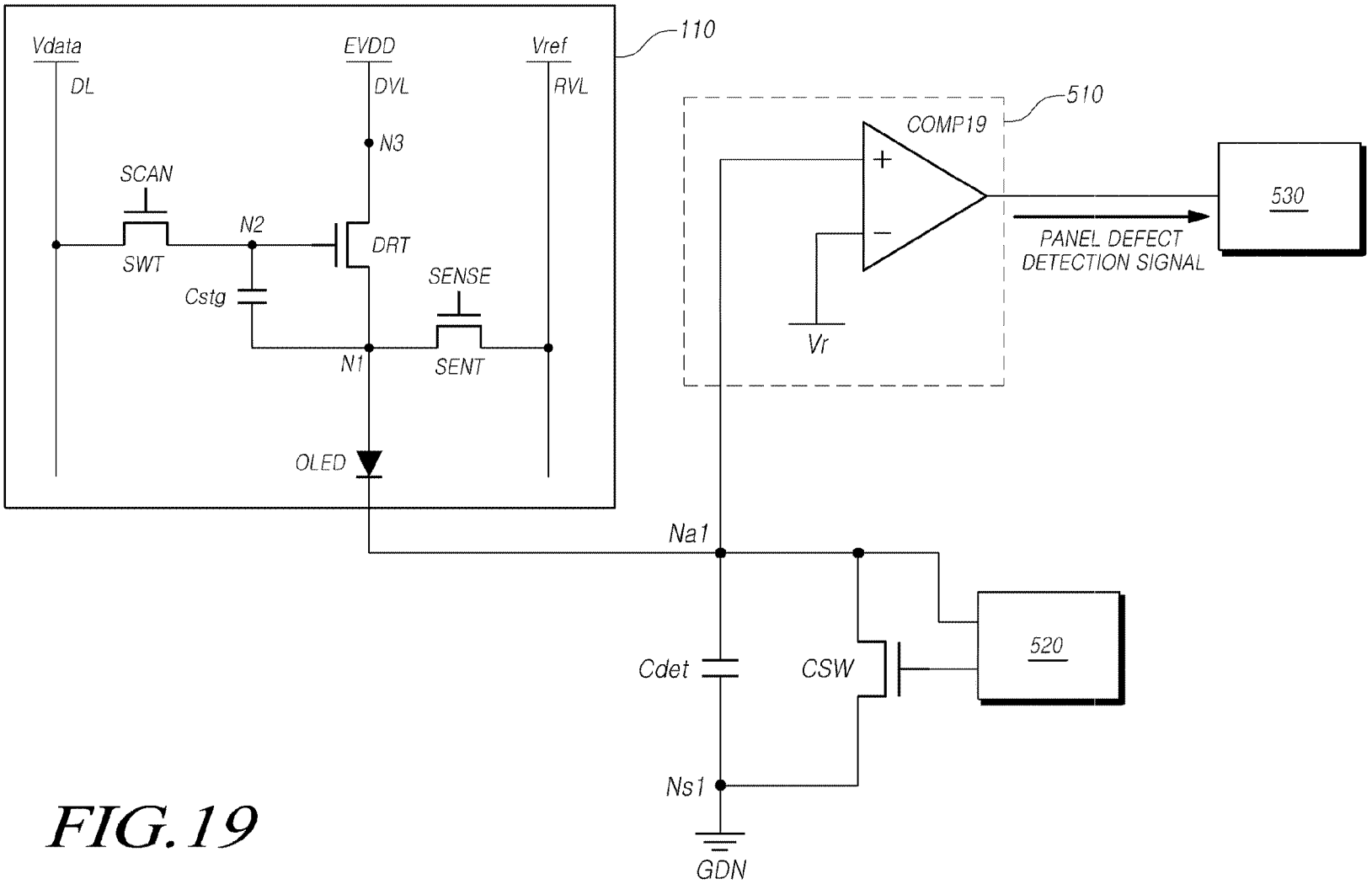

Referring to FIG. 16, FIG. 17, and FIG. 18, in the first panel defect detection system, the sensing module 510 may be implemented in an integrated circuit or semiconductor element for sensing a voltage of the application node Na1 or a potential difference between both ends of the impedance element for panel defect detection Z. Accordingly, the sensing module 510 may be easily implemented inside the control module 520.

As described above, the number of configurations for panel defect detection may be reduced by implementing the sensing module 510 inside the control module 520.

Referring to FIG. 17, for an example, the power supply unit 1310 which may be implemented in a DC-DC converter that may enable only current sourcing and suppress current sinking may have power supply controlled by the control module 520 without the switching element SW of FIG. 13.

In addition, for preventing an inverse current, an inverse current prevention diode Dib may not be connected between the power supply unit 1310 and the switching element SW as illustrated in FIG. 13, and the power supply unit 1310 may perform an inverse current prevention function which used to be performed by the inverse current prevention diode Dib, as illustrated in FIG. 18.

Meanwhile, the sensing module 510 may be implemented in a circuit like in FIG. 12 and FIG. 13. However, in some cases, the sensing module 510 may be implemented in an analog-to-digital (ADC) converter which converts an analog voltage value to a digital value.

Further, the sensing module 510 may be implemented including a comparator COMP19 that compares the voltage Va1 of the application node Na1 and a comparison reference voltage Vr.

The comparator COMP19 may output a panel defect detection signal when the voltage Va1 of the application node Na1 is higher than the comparison reference voltage Vr. Here, the comparison reference voltage Vr may be a voltage corresponding to the Zener voltage Vz of the Zener diode ZD of FIG. 12 and FIG. 13.

As described above, a simple sensing module 510 may be implemented through the comparator COMP19.

Figure 20:
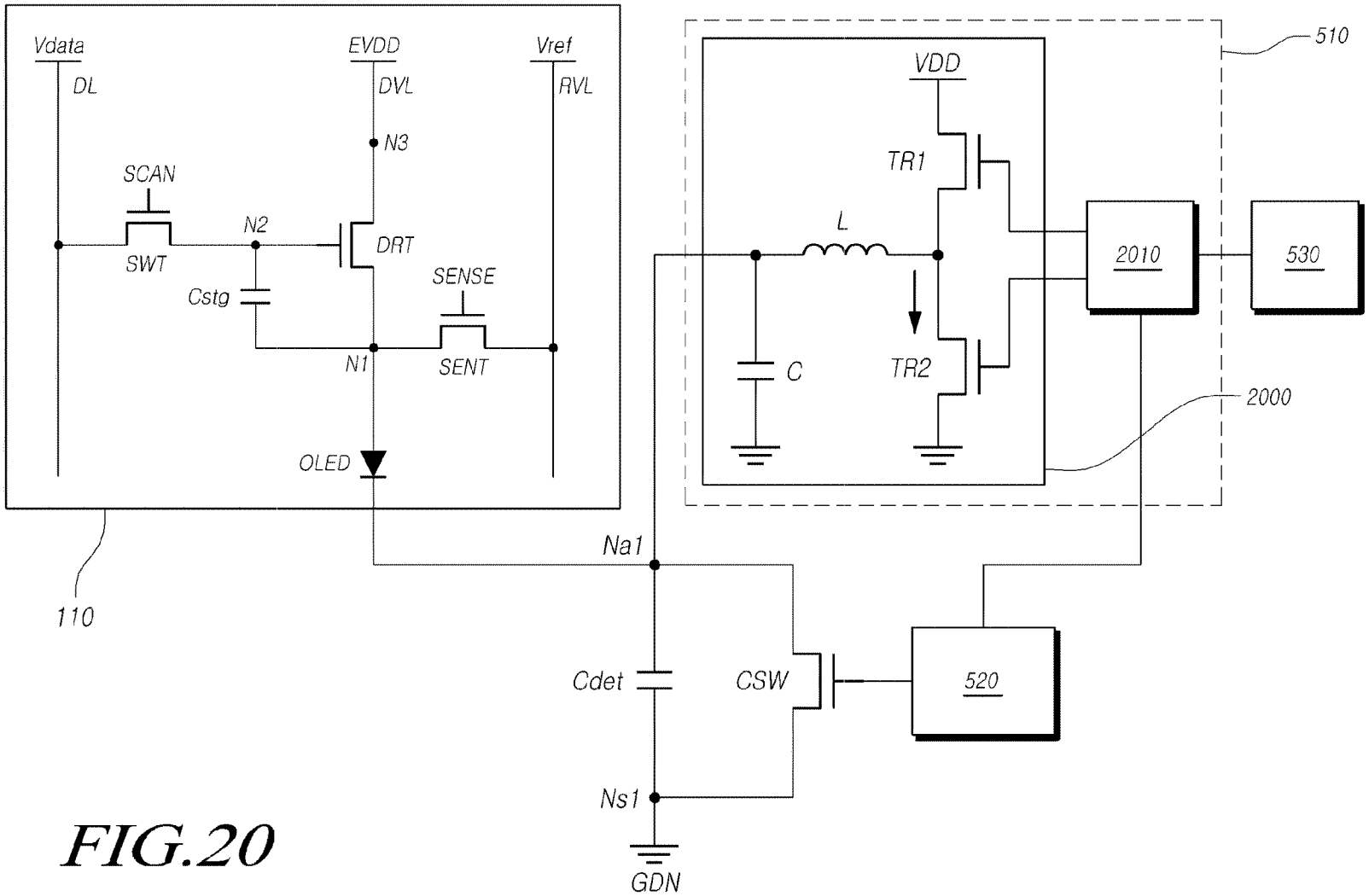
Figure 21:
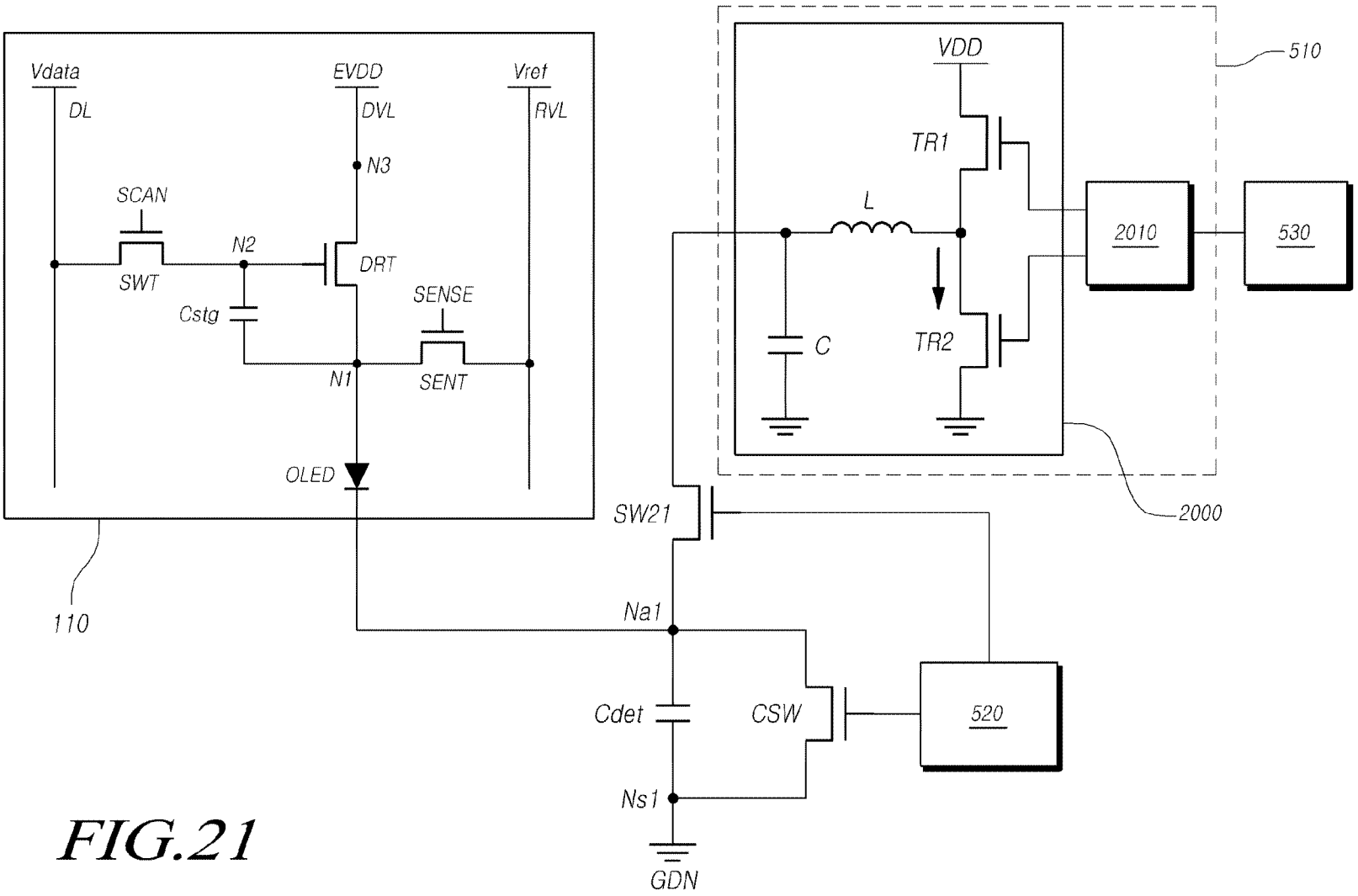

Referring to FIG. 20 and FIG. 21, the sensing module 510 may be implemented including a buck converter circuit 2000 connected to the application node Na1, a power integrated circuit 2010 that senses current flowing in a transistor TR2 included in the buck converter circuit 2000, and so on.

The buck converter circuit 2000, which is a type of a resistive direct current-direct current converter, may have an inductor L, two switching elements TR1, T2 controlling the inductor L, a capacitor C, and so on.

As described above, a panel defect may be more effectively detected when the sensing module 510 is used by making use of the buck converter circuit 2000.

The sensing module 510 may have a panel defect detection (abnormal current sensing) operation controlled by controlling the power integrated circuit 2010 by the control module 520 as illustrated in FIG. 20, or may have a panel defect detection (abnormal current sensing) operation controlled through a separate switching element SW21 as illustrated in FIG. 21.

Figure 22:
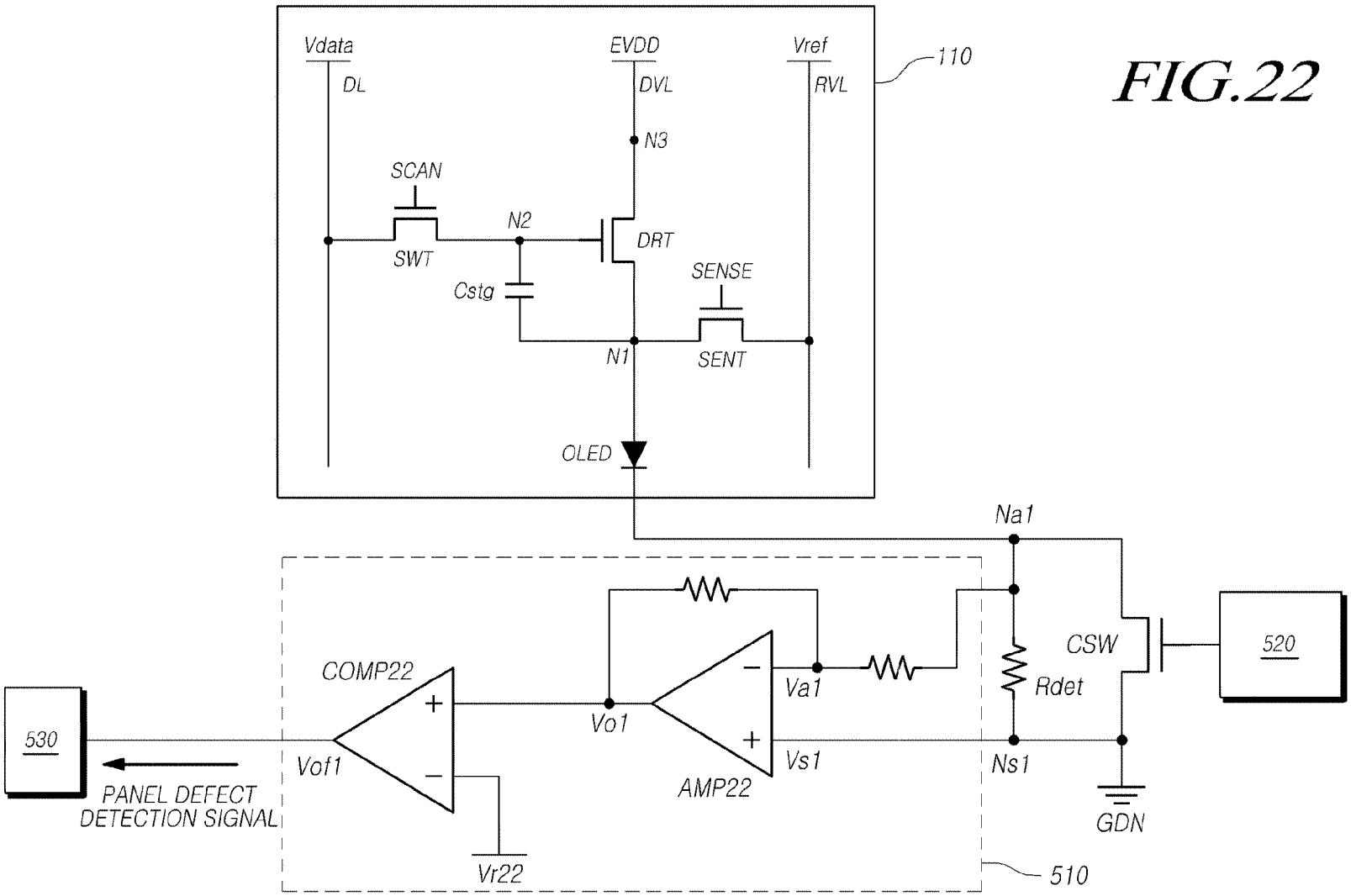
FIG. 22 and FIG. 23 are examples of implementation of a second panel defect detection system according to the present embodiments.
Figure 23:
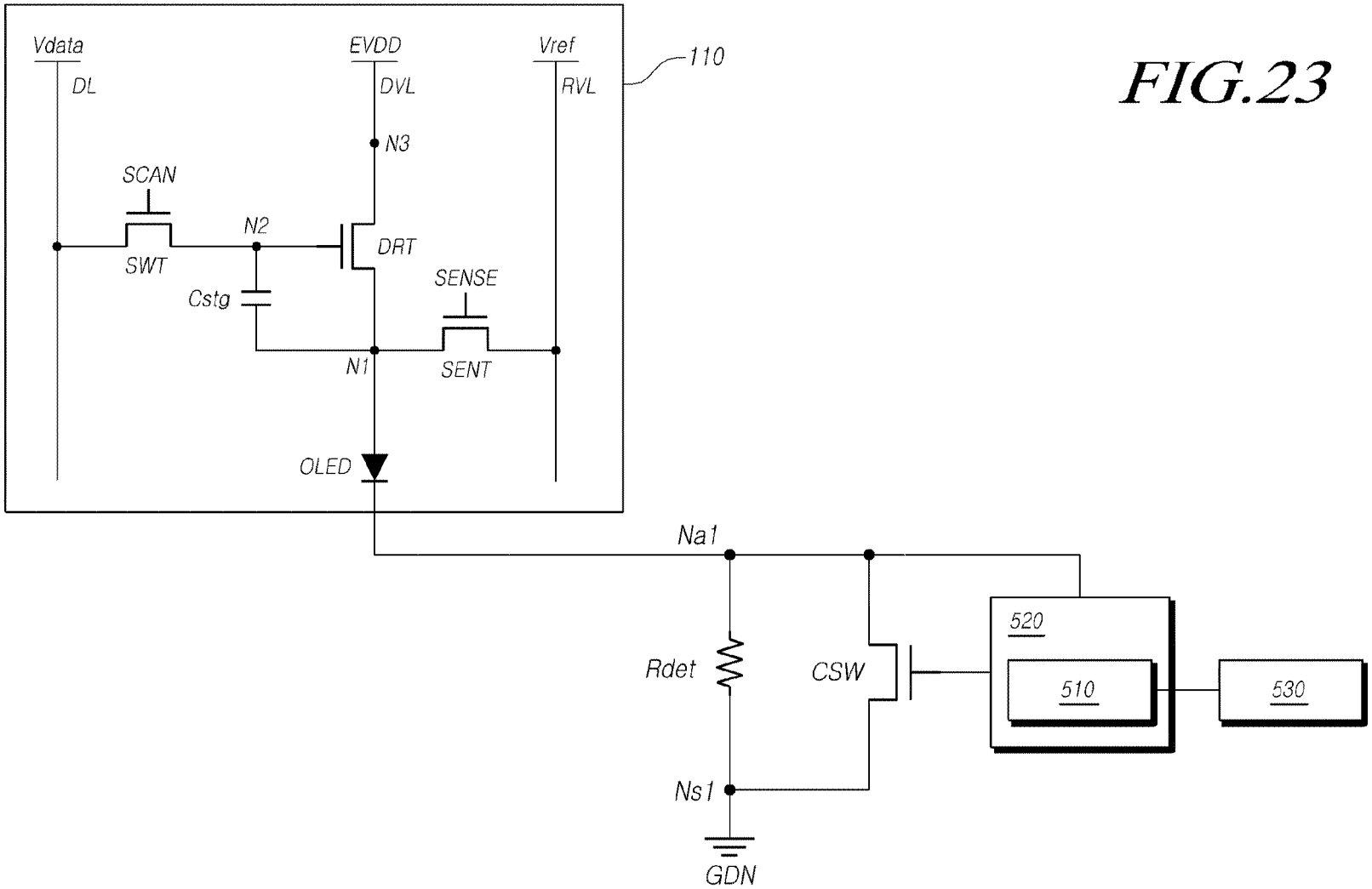

FIG. 22 and FIG. 23 are examples of implementation of a second panel defect detection system according to the present embodiments.

Referring to FIG. 22, in the first panel defect detection system that utilizes the application node Na1 in which the ground voltage EVSS is applied to the display panel 110, as a type of a panel driving voltage PDV, and utilizes the resistor for panel defect detection Rdet for the impedance element for panel defect detection Z, the sensing module 510 may be connected to both ends of the resistor for panel defect detection Rdet for the impedance element for panel defect detection Z, and sense a current (abnormal current) flowing through the application node Na1, based on the voltages Va1, Vs1 of both ends of the resistor for panel defect detection Rdet for the impedance element for panel defect detection Z.

As described above, when the resistor for panel defect detection Rdet for the impedance element for panel defect detection Z is utilized, a sensing scheme of an abnormal current Iab1, capable of effectively detecting a panel defect may be provided.

The sensing module 510, as illustrated in FIG. 22, may include a differential amplifier AMP22 that receives, as two input voltages, inputs of the voltages Va1, Vs1 of both ends of the resistor for panel defect detection Rdet corresponding to the impedance element for panel defect detection Z and outputs an output voltage Vo1 corresponding to differential gain-times difference between the two input voltages Va1, Vs1, a comparator COMP22 that receives inputs of the output voltage Vo1 of the differential amplifier AMP22 and the comparison reference voltage Vr22 and outputs a panel defect detection signal as an output signal Vof1, and so on.

As described above, when the resistor for panel defect detection Rdet for the impedance element for panel defect detection Z is utilized, the sensing module 510 for panel defect detection may be implemented using the voltages of both ends of the resistor for panel defect detection Rdet.

Referring to FIG. 23, in the second panel defect detection system that utilizes the application node Na1 in which the ground voltage EVSS is applied to the display panel 110, as a type of a panel driving voltage PDV, and utilizes the resistor for panel defect detection Rdet for the impedance element for panel defect detection Z, the sensing module 510 may be implemented in an integrated circuit or a semiconductor element and included in the control module 520.

Since the supply node Ns1 corresponds to the ground voltage node GDN, the sensing module 510 may only sense the voltage Va1 of the application node Na1 and output a panel defect detection signal.

FIG. 24 to FIG. 27 are examples of implementation of a third panel defect detection system according to the present embodiments.

Figure 24:
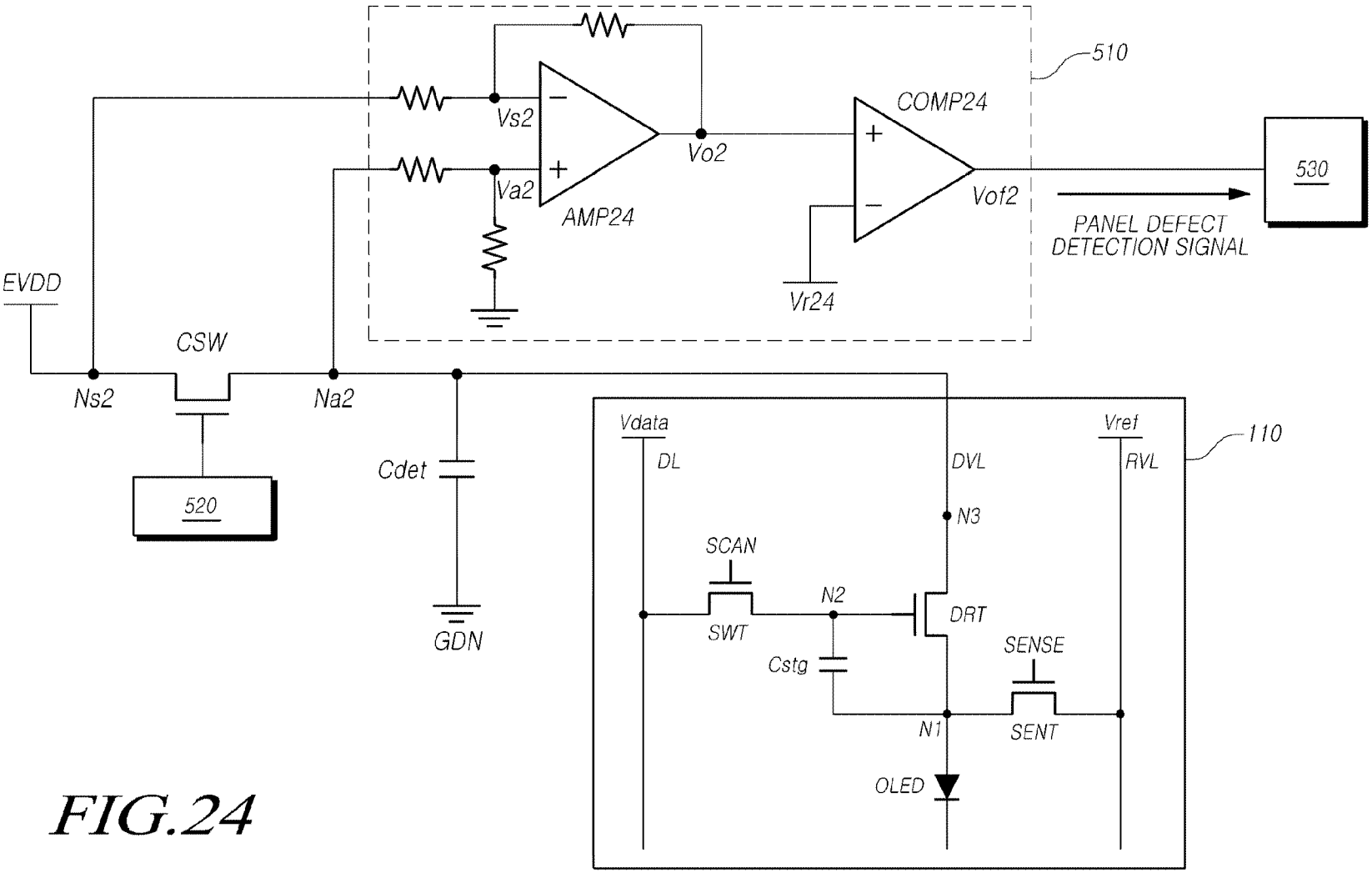
FIG. 24 to FIG. 27 are examples of implementation of a third panel defect detection system according to the present embodiments.

Referring to FIG. 24, in the third panel defect detection system that utilizes the application node Na2 in which a driving voltage EVDD is applied to the display panel 110, as another type of a panel driving voltage PDV, and utilizes the capacitor for panel defect detection Cdet for the impedance element for panel defect detection Z, the sensing module 510 may include a differential amplifier AMP24 that receives, as two input voltages, inputs of the voltage Va2 of the application node Na2 and the voltage Ns2 of the supply node Ns2 and outputs an output signal Vo2 corresponding to predetermined differential gain-times difference between the two input voltages, a comparator COMP24 that compares an output signal Vo2 of the differential amplifier AMP24 and the comparison reference voltage Vr24 and outputs an output signal Vof2 corresponding to a panel defect detection signal, and so on.

Figure 25:
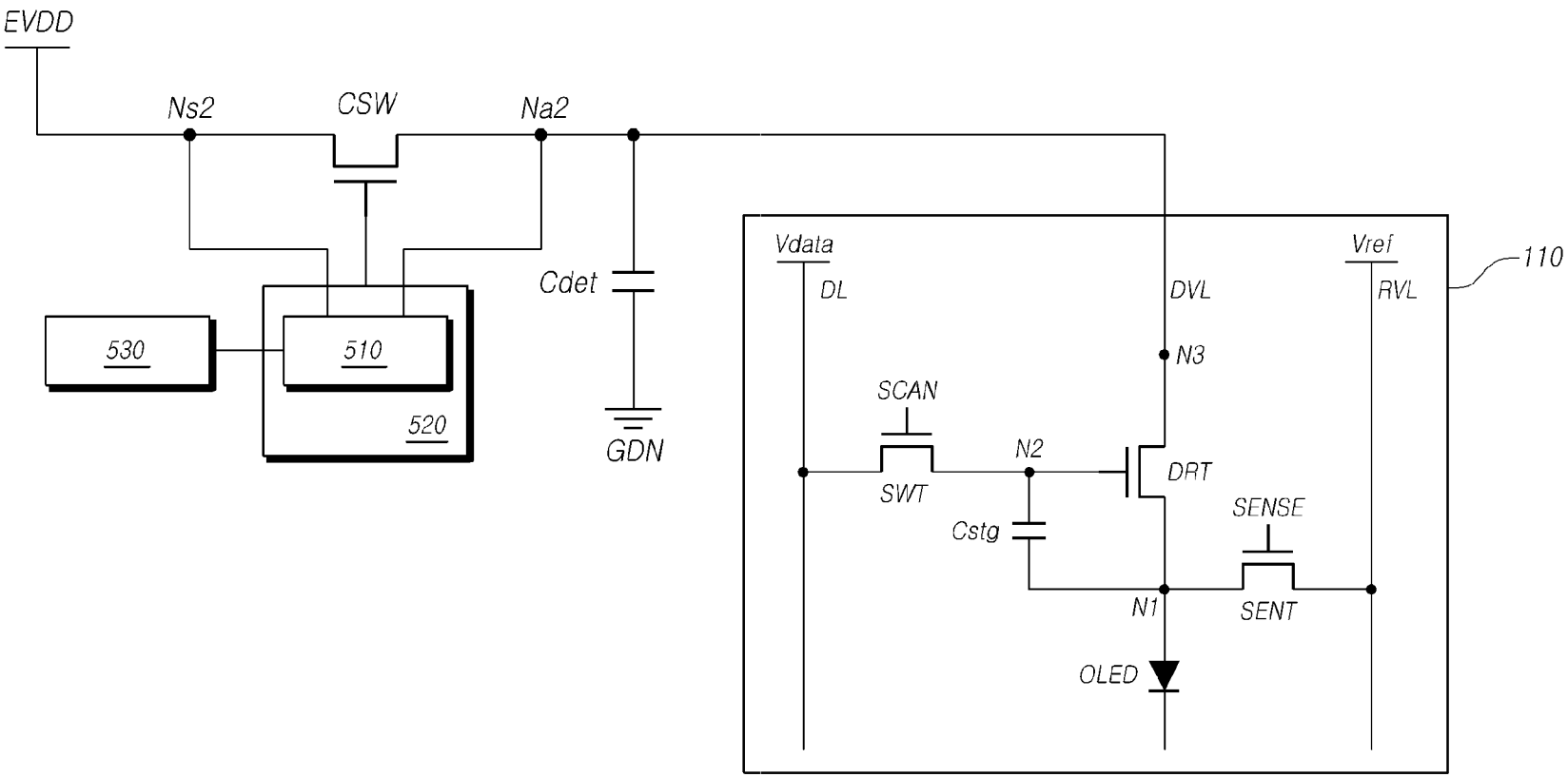

Referring to FIG. 25, in the third panel defect detection system that utilizes the application node Na2 in which a driving voltage EVDD is applied to the display panel 110, as another type of a panel driving voltage PDV, and utilizes the capacitor for panel defect detection Cdet for the impedance element Z for panel defect detection, the sensing module 510 may sense voltages of both ends of the control switching element CSW, that is, the voltage Va2 of the application node Na2 and the voltage Vs2 of the supply node Ns2.

The sensing module 510 may be implemented in an integrated circuit or a semiconductor element and included inside the control module 520.

Figure 26:
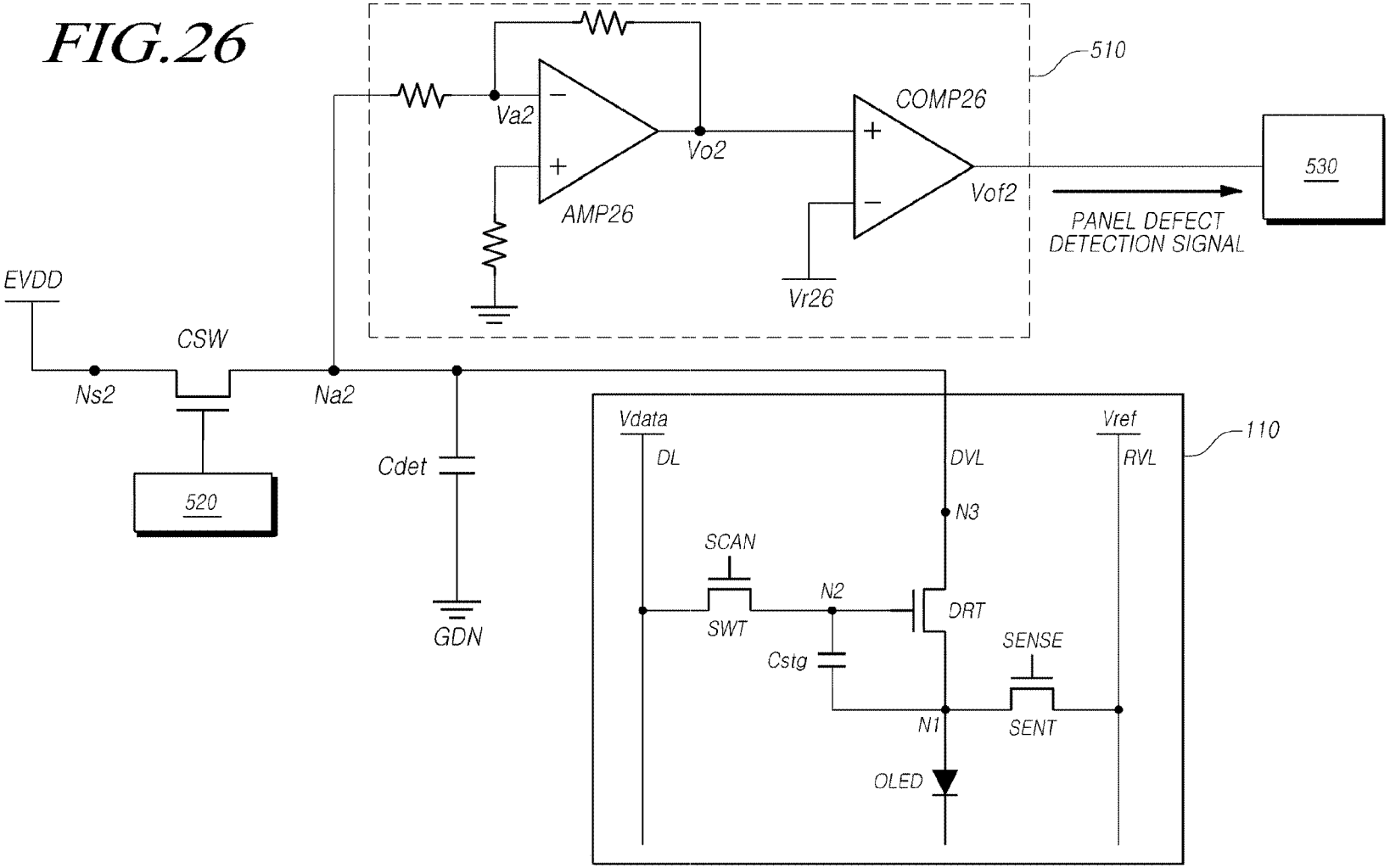

Referring to FIG. 26, in the third panel defect detection system that utilizes the application node Na2 in which a driving voltage EVDD is applied to the display panel 110, as another type of a panel driving voltage PDV, and utilizes the capacitor for panel defect detection Cdet for the impedance element Z for panel defect detection, the sensing module 510 may include a differential amplifier AMP26 that receives, as two input voltages, inputs of the voltage Va2 of the application node Na2 corresponding to the voltage of an end of the capacitor for panel defect detection Cdet for impedance element for panel defect detection Z and another voltage (e.g., a ground voltage) and outputs an output signal Vo2 corresponding to differential gain-times difference between the two input voltages, a comparator COMP26 that compares an output signal Vo2 of the differential amplifier AMP26 and the comparison reference voltage Vr26 and outputs an output signal Vof2 corresponding to a panel defect detection signal, and so on.

Figure 27:
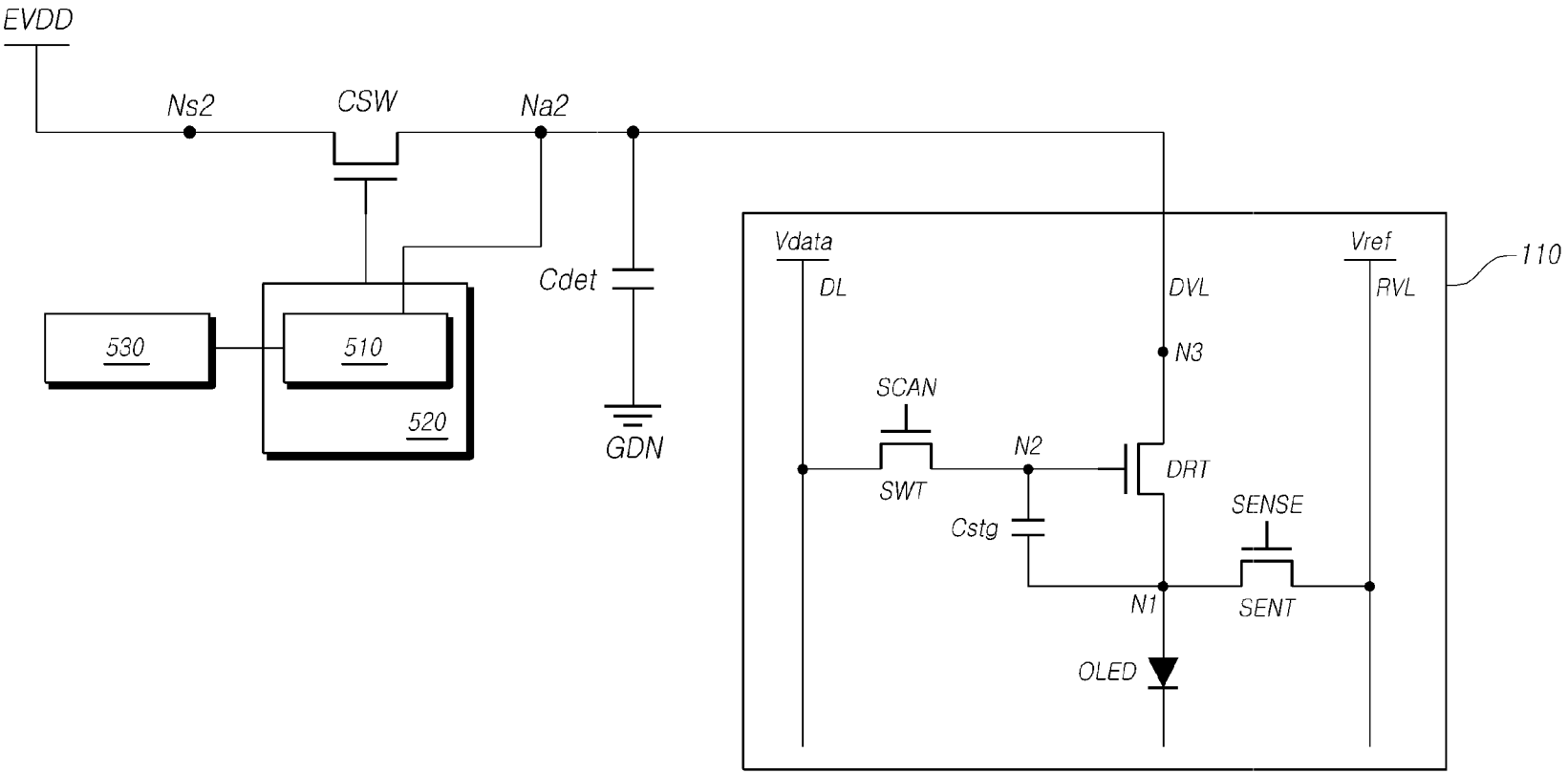

Referring to FIG. 27, in the third panel defect detection system that utilizes the application node Na2 in which a driving voltage EVDD is applied to the display panel 110, as another type of a panel driving voltage PDV, and utilizes the capacitor for panel defect detection Cdet for the impedance element Z for panel defect detection, the sensing module 510 may sense the voltage of an end of the control switching element CSW, that is, the voltage Va2 of the application node Na2.

The sensing module 510 may be implemented in an integrated circuit or a semiconductor element, and included inside the control module 520.

Figure 28:
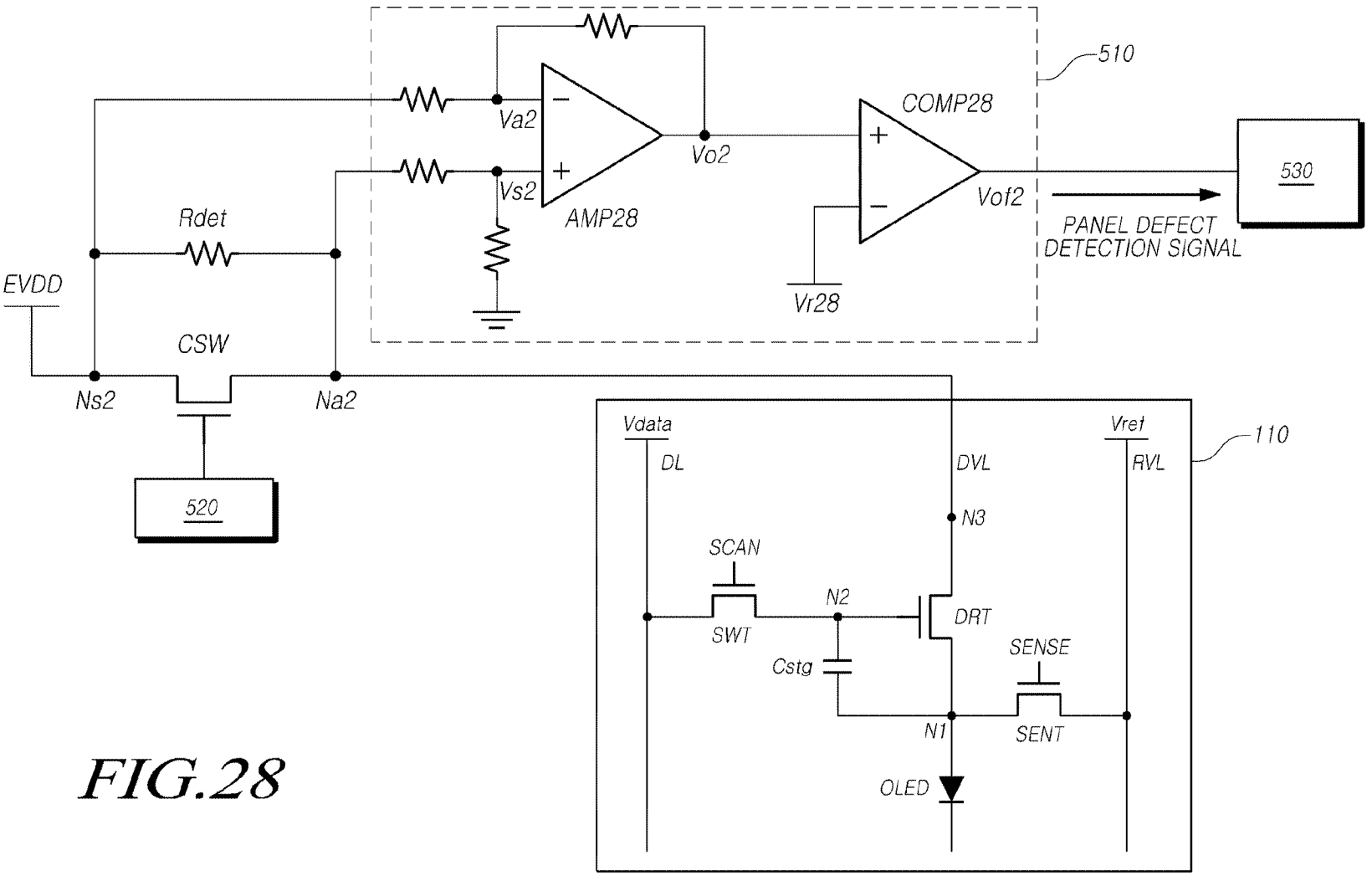
FIG. 28 and FIG. 29 are examples of implementation of a fourth panel defect detection system according to the present embodiments.
Figure 29:
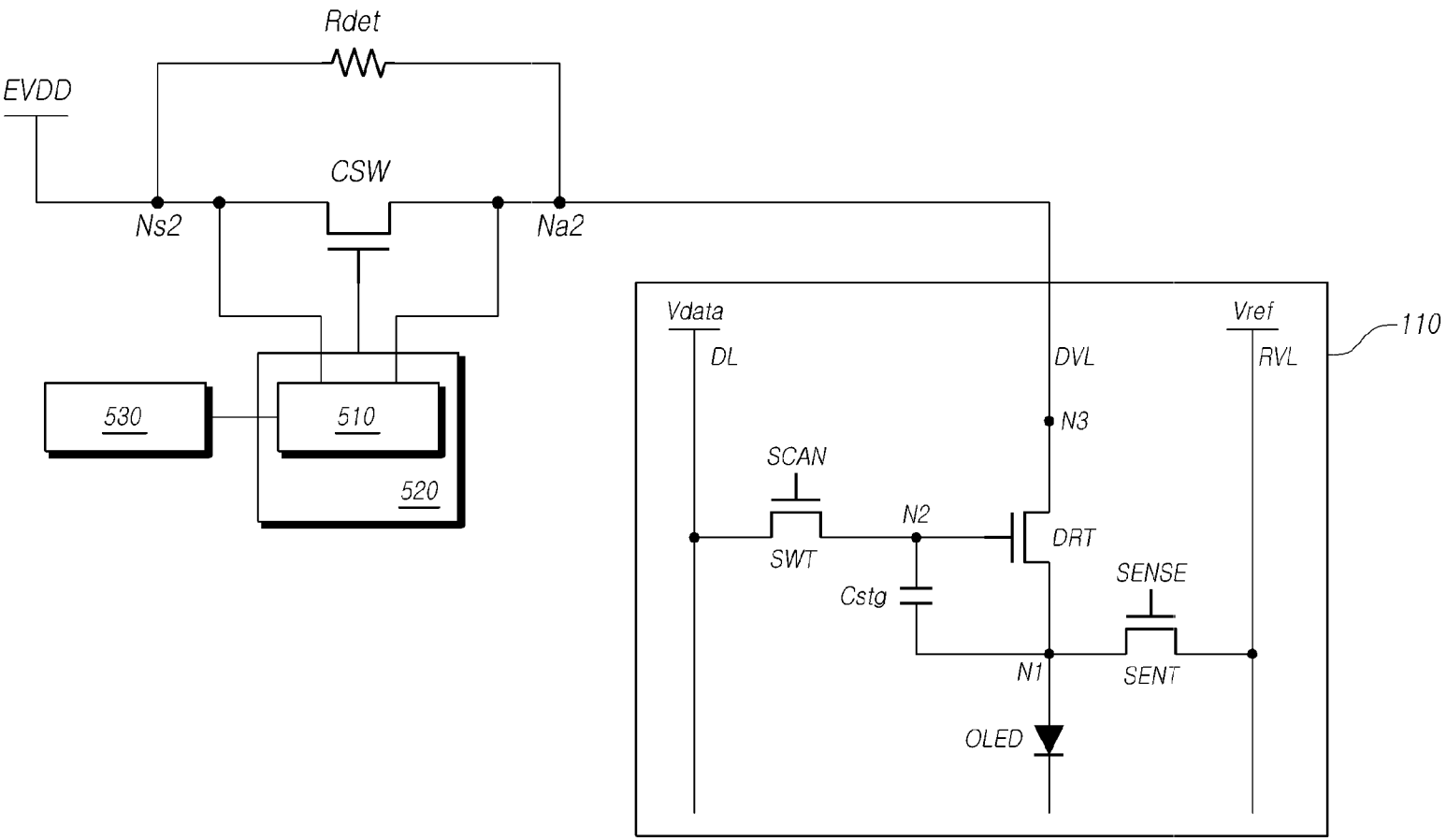

FIG. 28 and FIG. 29 are examples of implementation of a fourth panel defect detection system according to the present embodiments.

Referring to FIG. 28, in the fourth panel defect detection system that utilizes the application node Na2 in which a driving voltage EVDD is applied to the display panel 110, as another type of a panel driving voltage PDV, and utilizes the resistor for panel defect detection Rdet for the impedance element Z for panel defect detection, the sensing module 510 may include a differential amplifier AMP28 that receives, as two input voltages, inputs of the voltage Va2 of the application node Na2 and the voltage Vs2 of the supply node Ns2 and outputs an output signal Vo2 corresponding to predetermined differential gain-times difference between the two input voltages, a comparator COMP28 that compares an output signal Vo2 of the differential amplifier AMP28 and the comparison reference voltage Vr28 and outputs an output signal Vof2 corresponding to a panel defect detection, and so on.

Referring to FIG. 29, in the fourth panel defect detection system that utilizes the application node Na2 in which a driving voltage EVDD is applied to the display panel 110, as another type of a panel driving voltage PDV, and utilizes the resistor for panel defect detection Rdet for the impedance element Z for panel defect detection, the sensing module 510 may sense the voltages of both ends of the control switching element CSW, that is, voltages Va2, Vs2 of both ends of the resistor for panel defect detection Rdet.

The sensing module 510 may be implemented in an integrated circuit or a semiconductor element, and included inside the control module 520.

Figure 30:
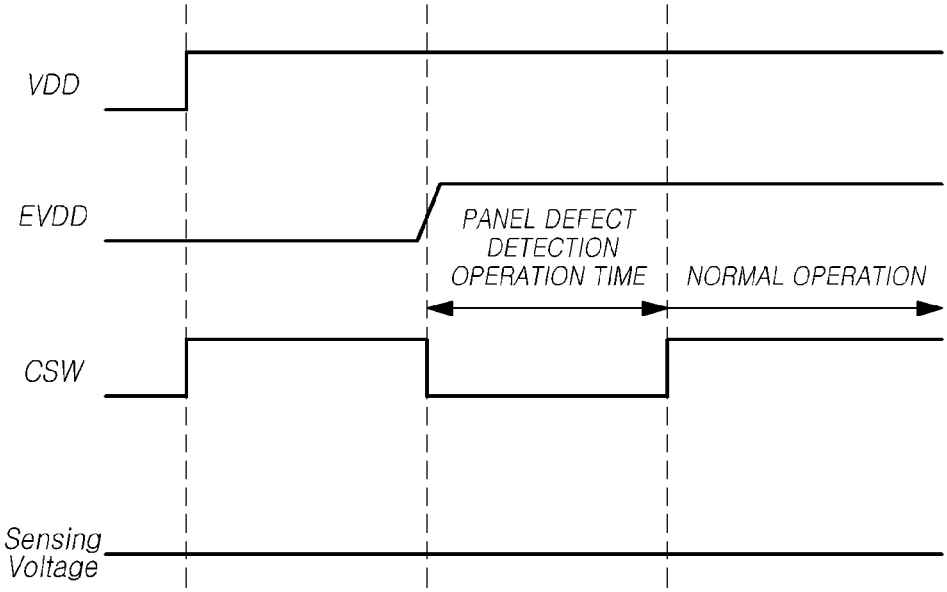
FIG. 30 is a diagram illustrating a main signal waveform related to a panel defect detection operation when no panel defect exists.
Figure 31:
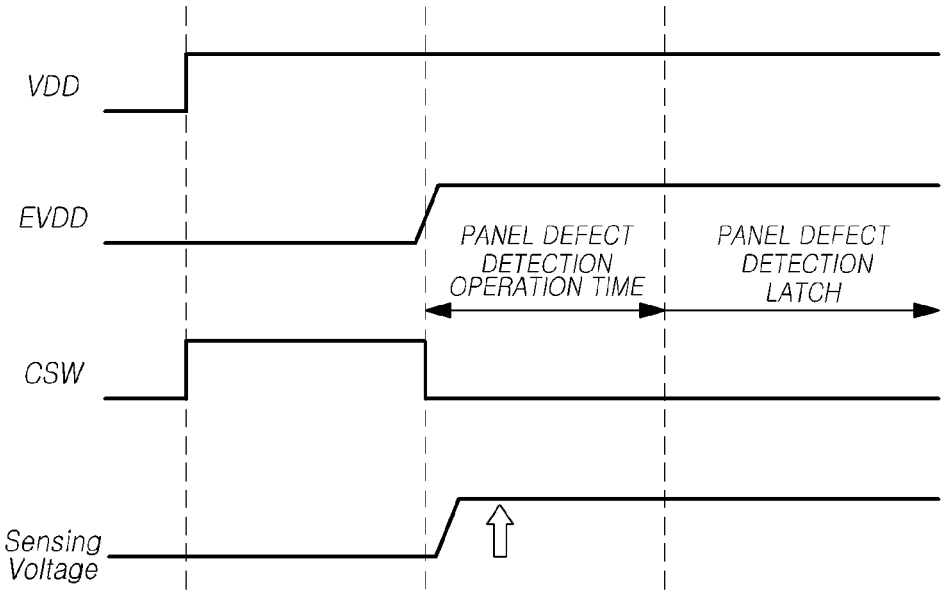
FIG. 31 is a diagram illustrating a main signal waveform related to a panel defect detection operation when a panel defect exists.

FIG. 30 is a diagram illustrating a main signal waveform related to a panel defect detection operation when no panel defect exists, and FIG. 31 is a diagram illustrating a main signal waveform related to a panel defect detection operation when a panel defect exists.

Referring to FIG. 30, the control switching element CSW is turned-off when a screen having brightness equal to or lower than a particular value, such as a black screen is displayed.

Accordingly, an interval in which a screen having brightness equal to or lower than a particular value is displayed, that is, an interval in which the control switching element CSW is turned-off, corresponds to a panel defect detection interval in which the described panel defect detection operation (a sensing operation and a panel defect countermeasure process) is being processed.

Referring to FIG. 30, since no panel defect exists, a sensed voltage (e.g., Va1, Va2, Vas1, Vas2, or the like) is maintained in a low level during the panel defect detection interval.

Referring to FIG. 30, since a panel defect exists, the control switching element CSW is turned-on again after the panel defect detection interval ends.

Referring to FIG. 31, the control switching element CSW is turned-off when a screen having brightness equal to or lower than a particular value, such as a black screen is displayed.

Accordingly, an interval in which a screen having brightness equal to or lower than a particular value is displayed, that is, an interval in which the control switching element CSW is turned-off corresponds to a panel defect detection interval in which the described panel defect detection operation (a sensing operation and a panel defect countermeasure process) is being processed.

Referring to FIG. 31, since a panel defect exists, a sensed voltage (e.g., Va1, Va2, Vas1, Vas2, or the like) is changed from a low level to a high level during a panel defect detection interval.

Referring to FIG. 31, since a panel defect exists, the control switching element CSW is maintained in an off-state even after a panel defect detection interval ends. A panel defect detection result is latched.

Figure 32:
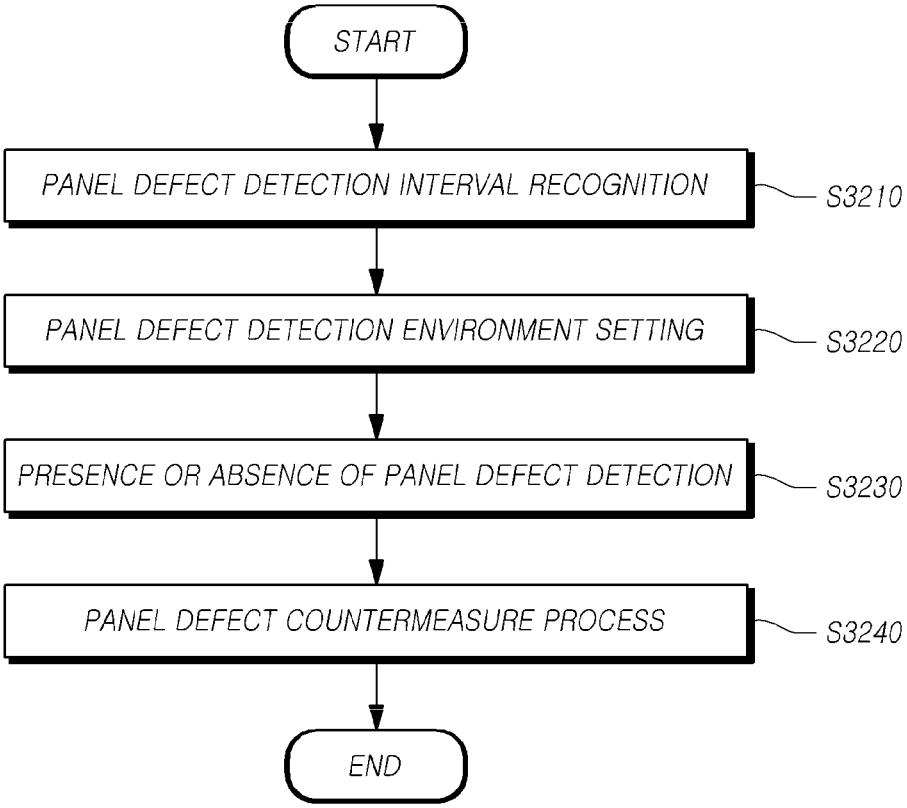
FIG. 32 is a flow diagram of a panel defect detection method according to the present embodiments.

FIG. 32 is a flow diagram of a panel defect detection method of the display device 100 according to the present embodiments.

Referring to FIG. 32, the panel defect detection method of the display device 100 according to the present embodiments includes a step for setting a panel defect detection environment S3220, a step for detecting whether or not a panel defect exists S3230, a step for processing a panel defect countermeasure S3240, and so on.

In the step for setting a panel defect detection environment S3220, a display device 100 may set a panel defect detection environment by turning off a control switching element CSW electrically connected between an application node Na in which a voltage PDV (e.g., EVSS, EVDD, etc.) used for driving a display panel 110, on which multiple data lines and multiple gate lines are arranged and multiple subpixels are arranged, is applied to the display panel 110 and a supply node Ns that supplies the voltage PDV (e.g., EVSS, EVDD, etc.) for being applied to the display panel 110.

In the step for detecting whether or not a panel defect exists S3230, the display device 100 may detect whether or not a panel defect exists, based on a result obtained by sensing the size or the presence or absence of occurrence of a current flowing from the display panel 110 to the application node Na when the control switching element CSW is turned-off.

In the step for processing a panel defect countermeasure S3240, the display device 100 may perform a predetermined countermeasure process when a current flowing from the display panel 110 to the application node Na occurs or the size of the current flowing from the display panel 110 to the application node Na is sensed to be equal to or greater than a threshold current value.

When a panel defect detection method of the display device 100 according to the present embodiments is used, the presence or absence of a panel defect may be quickly and conveniently detected by sensing a current flowing through the application node Na in which a voltage PDV used for driving the display panel 110 is applied to the display panel 110, in an off-situation of the control switching element CSW electrically connected between the application node Na in which a voltage PDV (e.g., EVSS, EVDD, etc.) used for driving the display panel 110 is applied to the display panel 110 and the supply node Ns that supplies the voltage for being applied to the display panel 110, that is, a situation where no abnormal current is allowed to occur in the display panel 110.

Meanwhile, referring to FIG. 32, the panel defect detection method of the display device 100 according to the present embodiments, may further include a step for recognizing a panel defect detection interval S3210 before the step for setting a panel defect detection environment S3220.

In the step for recognizing a panel defect detection interval S3210, the display device 100 may recognize, as a panel defect detection interval, an interval in which a screen (e.g., a black screen etc.) having brightness equal to or lower than a particular value is displayed, an interval in which a subpixel characteristic value is sensed, or an interval in which a screen (e.g., a black screen etc.) having brightness equal to or lower than a particular value is displayed while an image is being driven.

As described above, when no panel defect exist, the display panel 110 may recognize an interval in which no abnormal current occurs (1. an interval in which a screen having brightness equal to or lower than a particular value is displayed, 2. an interval in which a subpixel characteristic value is sensed, 3. an interval in which a screen having brightness equal to or lower than a particular value is displayed while an image is being driven) as a panel defect detection interval, so as to easily and accurately detect whether or not a panel defect exists, through the presence or absence of occurrence of the abnormal current.

According to the present embodiments as described above, a display device 100 capable of detecting a panel defect through sensing a current occurring in the display panel 110, a panel defect detection system, and a panel defect detection method may be provided.

In addition, according to the present embodiments, a display device 100 capable of more accurately detecting a panel defect by converting current generated in the display panel 110 to voltage and sensing the same, a panel defect detection system, and a panel defect detection method may be provided.

Further, according to the present embodiments, a display device 100 capable of enabling panel defect detection by a simple circuit, a panel defect detection system, and a panel defect detection method may be provided.

Further, according to the present embodiments, a display device 100 capable of accurately detecting various types of panel defects, a panel defect detection system, and a panel defect detection method may be provided.

Further, according to the present embodiments, a display device 100 capable of preventing a part of or an entire display panel 110 from being damaged or burned in advance, by immediately and quickly detecting a panel defect at the time of the occurrence of the panel defect, a panel defect detection system, and a panel defect detection method may be provided.

Further, according to the present embodiments, a display device 100 capable of detecting a panel defect without affecting a user's viewing or a screen operation at all, a panel defect detection system, and a panel defect detection method may be provided.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a display panel on which multiple data lines and multiple gate lines are arranged, and multiple subpixels are arranged;

a control switching element electrically connected between an application node in which a voltage used for driving the display panel is applied to the display panel and a supply node configured to supply the voltage to be applied to the display panel;

a sensing circuit configured to sense a current flowing through the application node or a voltage according to the current, when the control switching element is turned-off; and an impedance element for panel defect detection, having an end connected to the application node and another end directly electrically connected to the supply node or a ground voltage node.

2. The display device of claim 1, wherein the control switching element is turned-off to detect an abnormal current in the display panel.

3. The display device of claim 1, wherein the control switching element is turned-off in an interval in which a screen having brightness equal to or lower than a predetermined particular value is displayed.

4. The display device of claim 1, further comprising a control module configured to:

supply a gate signal corresponding to a control signal to a gate node of the control switching element; and control turn-on or turn-off of the control switching element.

5. The display device of claim 4, wherein:

the control switching element is located on the display panel or a printed circuit board;

the sensing circuit is located on the printed circuit board, or is included inside the control module, or is included inside a data driver; and the control module is located on the printed circuit board.

6. The display device of claim 1, wherein the impedance element for panel defect detection is a resistor for panel defect detection, having an end connected to the application node and another end directly connected to the supply node.

7. The display device of claim 1, wherein the impedance element for panel defect detection is a capacitor for panel defect detection having an end connected to the application node and another end directly connected to the ground voltage node or the supply node.

8. The display device of claim 1, wherein the sensing circuit senses a current flowing through the application node by sensing a voltage of the application node, an impedance of the impedance element for panel defect detection, or a potential difference between the application node and the supply node, when the control switching element is turned-off.

9. The display device of claim 8, further comprising a panel defect countermeasure processing unit configured to assume that an abnormal current has occurred through the application node, to store a panel defect code, store panel defect location information, or output a panel defect countermeasure control signal, when the control switching element is turned-off and in a case in which the voltage of the application node is equal to or greater than a threshold voltage, the impedance of the impedance element for panel defect detection is equal to or greater than a threshold impedance, or the potential difference between the application node and the supply node is equal to or greater than a threshold potential difference.

10. The display device of claim 1, wherein the sensing circuit comprises:

a panel defect detection transistor configured to be turned-on according to a voltage change in the application node and output a panel defect detection signal; and a Zener diode connected between a gate node of the panel defect detection transistor and the application node.

11. The display device of claim 1, wherein the sensing circuit is an integrated circuit or semiconductor element for sensing a voltage change in the application node or a potential difference of both ends of the impedance element for panel defect detection.

12. The display device of claim 1, wherein the sensing circuit comprises a comparator configured to compare a voltage of the application node and a comparison reference voltage.

13. The display device of claim 1, wherein the sensing circuit is connected to both ends of the impedance element for panel defect detection to sense a current flowing through the application node, based on voltages of both ends of the impedance element for panel defect detection.

14. The display device of claim 1, wherein the sensing circuit comprises:

a buck converter circuit connected to the application node; and a power integrated circuit configured to sense a current flowing in a transistor included in the buck converter circuit.

15. The display device of claim 1, wherein the sensing circuit comprises:

a differential amplifier configured to receive, as two input voltages, inputs of voltages of both ends of the impedance element for panel defect detection, or receive, as two input voltages, inputs of a voltage of an end of the impedance element for panel defect detection and the other voltage, and output an output voltage corresponding to differential gain-times difference between the two input voltages; and a comparator configured to receive inputs of the output voltage of the differential amplifier and a comparison reference voltage, to output a panel defect detection signal as an output signal.

16. The display device of claim 1, wherein when the display panel is an organic light emitting display panel on which multiple subpixels, each of which including an organic light emitting diode and a driving transistor to drive the organic light emitting diode, are arranged, further comprising:

a power supply unit configured to supply a ground voltage corresponding to a reverse voltage to the application node during an interval in which a characteristic value of the driving transistor is measured; and a switching element configured to be turned-on to electronically connect the application node and the power supply unit during an interval in which a characteristic value of the driving transistor is measured.

17. The display device of claim 16, wherein an inverse current prevention diode is electrically connected between the power supply unit and the switching element, or an inverse current prevention circuit is included in the power supply unit.

18. The display device of claim 1, wherein, when the display panel is an organic light emitting display panel on which multiple subpixels, each of which including an organic light emitting diode and a driving transistor to drive the organic light emitting diode, are arranged, the voltage used for driving the display panel is a voltage applied to a drain node or source node of the driving transistor, or a voltage applied to an anode electrode or cathode electrode of the organic light emitting diode.

19. A display device, comprising:

a display panel on which multiple data lines and multiple gate lines are arranged, and multiple subpixels are arranged;

a sensing circuit configured to sense whether an abnormal current has occurred in the display panel when a screen having brightness equal to or lower than a particular value is displayed on the display panel; and an impedance element for panel defect detection, having an end connected to the application node and another end directly electrically connected to the supply node or a ground voltage node.

20. A panel defect detection system, comprising:

a control switching element electrically connected between:

an application node in which a voltage used for driving a display panel is applied to the display panel; and a supply node configured to supply the voltage to be applied to the display panel;

a sensing circuit configured to perform sensing a current flowing through the application node or a voltage according to the current, and detect whether or not a panel defect exists, based on a result obtained by the sensing, when the control switching element is turned-off; and an impedance element for panel defect detection, having an end connected to the application node and another end directly electrically connected to the supply node or a ground voltage node.

21. A panel defect detection method of a display device comprising a display panel on which multiple data lines and multiple gate lines are arranged and multiple subpixels are arranged, the method comprising:

recognizing:

a panel defect detection interval;

an interval in which a screen having brightness equal to or lower than a particular value is displayed;

an interval in which a characteristic value of a subpixel is sensed; or an interval in which a screen having brightness equal to or lower than a particular value is displayed while an image is being driven;

setting a panel defect detection environment by turning-off a control switching element electrically connected between:

an application node in which a voltage used for driving the display panel is applied to the display panel; and a supply node configured to supply the voltage to be applied to the display panel;

detecting whether or not a panel defect exists, based on a sensing result obtained by sensing the size or the presence or absence of occurrence of a current flowing to the application node in the display panel, when the control switching element is turned-off, using an impedance element for panel defect detection, having an end connected to the application node and another end directly electrically connected to the supply node or a ground voltage node; and performing a predetermined panel defect countermeasure process when a current flowing to the application node is generated in the display panel or the size of the current flowing to the application node in the display panel is sensed to be equal to or greater than a threshold current value.

22. A display device, comprising:

a display panel on which multiple data lines and multiple gate lines are arranged, and multiple subpixels are arranged;

a control switching element electrically connected between an application node in which a voltage used for driving the display panel is applied to the display panel and a supply node configured to supply the voltage to be applied to the display panel;

a sensing circuit configured to sense a current flowing through the application node or a voltage according to the current, when the control switching element is turned-off;

an impedance element for panel defect detection, having an end connected to the application node and another end connected to the supply node or a ground voltage node; and a control module configured to supply a gate signal corresponding to a control signal to a gate node of the control switching element and the gate signal controls turn-on or turn-off the control switching element.

23. A panel defect detection system, comprising:

a control switching element electrically connected between:

an application node in which a voltage used for driving a display panel is applied to the display panel; and a supply node configured to supply the voltage to be applied to the display panel;

a sensing circuit configured to perform sensing a current flowing through the application node or a voltage according to the current, and detect whether or not a panel defect exists, based on a result obtained by the sensing, when the control switching element is turned-off;

an impedance element for panel defect detection, having an end connected to the application node and another end connected to the supply node or a ground voltage node; and a control module configured to supply a gate signal corresponding to a control signal to a gate node of the control switching element and the gate signal controls turn-on or turn-off the control switching element.

* * * * *